US010870816B2

(12) United States Patent
Fossum et al.

(10) Patent No.: US 10,870,816 B2
(45) Date of Patent: Dec. 22, 2020

(54) FABRIC TREATMENT COMPOSITIONS HAVING LOW CALCULATED CATIONIC CHARGE DENSITY POLYMERS AND FABRIC SOFTENING ACTIVES AND METHODS FOR PROVIDING A BENEFIT

(71) Applicant: The Procter & Gamble Company, Cincinnati, OH (US)

(72) Inventors: Renae Dianna Fossum, Middletown, OH (US); Gledison Fonseca, Mannheim (DE); Aaron Flores-Figuero, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 251 days.

(21) Appl. No.: 15/356,101

(22) Filed: Nov. 18, 2016

(65) Prior Publication Data

US 2018/0142187 A1 May 24, 2018

(51) Int. Cl.

| | |
|---|---|
| ***C11D 3/00*** | (2006.01) |
| ***C11D 3/30*** | (2006.01) |
| ***C11D 3/37*** | (2006.01) |
| ***C11D 1/62*** | (2006.01) |

(52) U.S. Cl.

CPC ..... *C11D 3/001* (2013.01); *C11D 1/62* (2013.01); *C11D 3/0026* (2013.01); *C11D 3/30* (2013.01); *C11D 3/373* (2013.01); *C11D 3/3769* (2013.01)

(58) Field of Classification Search

CPC ..... C11D 3/00; C11D 3/30; C11D 3/37

See application file for complete search history.

(56) References Cited

U.S. PATENT DOCUMENTS

| | | | | |
|---|---|---|---|---|
| 5,114,600 | A | 5/1992 | Biggin | |
| 5,811,087 | A | 9/1998 | Moehring | |
| 6,251,849 | B1 | 6/2001 | Jeschke | |
| 6,642,200 | B1 | 11/2003 | Zhang | |
| 6,864,223 | B2 | 3/2005 | Smith | |
| 7,304,026 | B2 | 12/2007 | Heibel | |
| 7,452,854 | B2 | 11/2008 | Green | |
| 7,659,238 | B2 | 2/2010 | Martin | |
| 8,183,199 | B2 | 5/2012 | Fossum | |
| 8,546,314 | B2 | 10/2013 | Randall | |
| 9,080,130 | B2 | 7/2015 | Sivik | |
| 9,404,068 | B2 | 8/2016 | Sakurai | |
| 9,534,191 | B2 | 1/2017 | Fernandez-prieto | |
| 9,809,782 | B2 | 11/2017 | Panandiker | |
| 2001/0034315 | A1* | 10/2001 | Grainger | C11D 1/835 510/327 |
| 2002/0132749 | A1* | 9/2002 | Smith | C11D 1/62 510/327 |
| 2004/0023836 | A1* | 2/2004 | Moorfield | D06M 13/148 510/475 |
| 2004/0116321 | A1* | 6/2004 | Salesses | C11D 1/62 510/515 |
| 2005/0256027 | A1* | 11/2005 | Heibel | C11D 1/40 510/515 |
| 2006/0094639 | A1* | 5/2006 | Martin | C11D 3/0015 510/517 |
| 2006/0252669 | A1* | 11/2006 | Heibel | C11D 1/40 510/515 |
| 2007/0099817 | A1* | 5/2007 | Smith | C11D 1/62 510/515 |
| 2007/0202069 | A1* | 8/2007 | Tamareselvy | A61K 8/894 424/70.12 |
| 2008/0167453 | A1* | 7/2008 | Goettel | A61K 8/416 534/560 |
| 2010/0050346 | A1 | 3/2010 | Corona, III | |
| 2010/0056419 | A1* | 3/2010 | Corona, III | C11D 3/0021 510/338 |
| 2010/0325812 | A1* | 12/2010 | Panandiker | C11D 3/0015 8/137 |
| 2011/0184040 | A1* | 7/2011 | Taranta | A01N 43/22 514/427 |
| 2011/0269663 | A1* | 11/2011 | Clowes | C11D 1/62 510/515 |
| 2011/0281782 | A1* | 11/2011 | Panandiker | C11D 3/001 510/329 |
| 2012/0004156 | A1* | 1/2012 | Panandiker | C11D 1/008 510/516 |
| 2012/0027824 | A1 | 2/2012 | Emenwein | |
| 2012/0031421 | A1* | 2/2012 | Washington | A45D 7/06 132/206 |
| 2012/0071383 | A1 | 3/2012 | Perez-prat | |
| 2012/0077725 | A1* | 3/2012 | Wang | C11D 3/227 510/285 |
| 2012/0137448 | A1* | 6/2012 | Panandiker | C11D 1/62 8/137 |
| 2012/0142578 | A1* | 6/2012 | Panandiker | C11D 1/667 510/515 |

(Continued)

FOREIGN PATENT DOCUMENTS

| | | | | |
|---|---|---|---|---|
| CA | 2482306 | A1 * | 3/2003 | A01N 33/12 |
| DE | 10200474 | A1 | 7/2003 | |

(Continued)

OTHER PUBLICATIONS

International Search Report; International Application No. PCT/US2017/061493; dated Jan. 23, 2018; 13 pages.

(Continued)

*Primary Examiner* — Mark Eashoo
*Assistant Examiner* — M. Reza Asdjodi
(74) *Attorney, Agent, or Firm* — Gregory S. Darley-Emerson

(57) ABSTRACT

A fabric treatment composition having a polymer and a fabric softening active. The polymer includes a cationic repeating unit and a non-cationic repeating unit. The polymer has a weight-average molecular weight of from about 40,000 to about 600,000 Daltons. The polymer has a calculated cationic charge density of from about 0.05 to about 2 meq/g at a pH of between about 2 and about 8. The polymer includes less than about 0.1% by mole of a cross-linking agent. The fabric softening active includes a quaternary ammonium compound. The composition has less than about 5% by weight of the composition of an anionic surfactant.

16 Claims, No Drawings

(56) References Cited

U.S. PATENT DOCUMENTS

| | | | | |
|---|---|---|---|---|
| 2013/0108571 | A1 | 5/2013 | Adamy | |
| 2013/0121944 | A1* | 5/2013 | Leyrer | C11D 3/3765 424/70.16 |
| 2013/0310301 | A1* | 11/2013 | Sivik | C11D 1/62 510/516 |
| 2015/0017214 | A1* | 1/2015 | Warr | A61Q 5/12 424/401 |
| 2015/0159119 | A1* | 6/2015 | Fernandez-Prieto | C11D 1/62 510/527 |
| 2015/0197708 | A1 | 7/2015 | Jin | |
| 2015/0329799 | A1 | 11/2015 | Schramm, Jr. | |
| 2016/0024427 | A1* | 1/2016 | Sivik | C11D 1/62 8/137 |
| 2016/0032220 | A1* | 2/2016 | Sivik | C11D 3/001 510/515 |
| 2016/0060574 | A1 | 3/2016 | Panandiker | |
| 2016/0237381 | A1 | 8/2016 | Chen | |
| 2016/0296656 | A1 | 10/2016 | Scavone | |
| 2017/0298294 | A1 | 10/2017 | Köhle | |
| 2018/0142187 | A1 | 5/2018 | Fossum | |
| 2018/0142188 | A1 | 5/2018 | Fossum | |
| 2019/0264142 | A1 | 8/2019 | O'neil | |

FOREIGN PATENT DOCUMENTS

| | | | | |
|---|---|---|---|---|
| EP | 1375633 | A1 | 1/2004 | |
| JP | 2010285737 | A | 12/2010 | |
| WO | WO9420597 | A1 | 9/1994 | |
| WO | WO-02057400 | A2 * | 7/2002 | C11D 1/62 |
| WO | WO03102043 | A1 | 12/2003 | |
| WO | WO-2004050812 | A1 * | 6/2004 | C11D 3/0015 |
| WO | WO2004050812 | A1 | 6/2004 | |
| WO | WO-2005087907 | A1 * | 9/2005 | C11D 3/3723 |
| WO | WO2008005693A2 | A2 | 1/2008 | |
| WO | WO-2013189010 | A1 * | 12/2013 | C11D 1/62 |
| WO | WO2015143997 | A1 | 10/2015 | |
| WO | WO2016014744 | A1 | 1/2016 | |

OTHER PUBLICATIONS

International Search Report; International Application No. PCT/US2017/061494; dated Jan. 30, 2018; 14 pages.

International Search Report; International Application No. PCT/US2017/062243; dated Feb. 27, 2018; 13 pages.

Luviquat® Polymer Grades; Quaternized copolymers for hair and skin care; Technical Information; Nov. 2005; Supersedes issue dated Oct. 2005; downloaded Aug. 11, 2020; http://www.rumapel.com.ar/cosmetica_agentes/ficha_tecnica/Luviquat%20Polymer%20Grades.pdf; 32 pages.; BASF Aktiengesellschaft.

* cited by examiner

FABRIC TREATMENT COMPOSITIONS HAVING LOW CALCULATED CATIONIC CHARGE DENSITY POLYMERS AND FABRIC SOFTENING ACTIVES AND METHODS FOR PROVIDING A BENEFIT

FIELD OF THE INVENTION

The present disclosure is directed to fabric treatment compositions having fabric softening actives, and methods of using the same.

BACKGROUND OF THE INVENTION

When consumers wash their clothes, they want their fabrics to maintain the initial appearance as when newly purchased so they are like new, feel soft, and smell fresh. Consumers know that they need to wash their clothes to be clean, but when new clothes are washed, the fabric of the clothes begins to lose its new looking appearance. Conventional detergents often provide desirable cleaning and stain removal benefits, but washed fabrics may lose some of the initial appearance from purchase because the color fades or loses some of its original intensity after washing. To provide for soft feel and freshness, consumers typically add liquid fabric softeners to their laundry regimen. Fabric softeners can help to deliver soft feel and freshness benefits through the rinse cycle, and can help to maintain appearance of new clothes through a limited number of wash cycles. However, fabric softening actives can build up on fabrics over time. This build up can lead to an undesirable, heavy feel on fabrics, or lead to a fading of color. Therefore, it would be beneficial to provide a single rinse-added product that provides for softness, freshness, and maintains, or even improves, the new looking appearance of fabrics over the lifetime of the clothes.

The color of new fabrics can appear faded or dull after laundering due to fabric abrasion that occurs during the wash process. This abrasive damage leads to fibers loosening, and fibrils or fuzz being formed. Protruding fibers or fibrils may scatter light, and produce an optical effect of diminished color intensity. One way to maintain, or improve, the color on damaged fabrics is via water insoluble, hydrophobic particles formed from cationic polymer and anionic surfactant via a coacervate. These hydrophobic particles deposit on the fabric surface to prevent abrasion, and they can re-set fibers or fibrils on damaged fabrics. Resetting the fibers or fibrils is believed to result in smoother yarns, thereby reducing the number of fibers or fibrils protruding from the fabric surface. As a result, there is decreased light scattering from the fabric and a more intense color is perceived by the consumer as compared to an untreated fabric.

Wash-added compositions have been described that combine cationic polymer and anionic surfactant in a wash-added composition. However, the problems with these wash-added compositions include that the cationic polymer can interfere with cleaning since the anionic surfactant needed for cleaning forms a coacervate with the cationic polymer and the coacervate formed during the wash process can re-deposit the dirt removed from the clothes by the detergent. A solution to these aforementioned problems is to add the cationic polymer during the rinse cycle of the wash process and rely on the anionic surfactant carry-over in the rinse water. However anionic surfactant carry-over levels found in the rinse water can be low. It has been surprisingly found that high levels of cationic polymer that are in excess of the anionic carry-over in the rinse liquor may deliver the desired appearance benefit on fabrics when used in combination with typical cationic fabric softening actives used in commercial fabric softeners. Without wishing to be bound by theory, when anionic carry-over, excess cationic polymer, and cationic fabric softening active are present, a separated phase forms in the rinse liquor that is able to deposit on fabrics to reset fibers or fibrils when the polymers go through a tacky phase upon drying, resulting in smoother yarns or fabrics and overall better, newer looking appearance.

Formulating compositions that deliver appearance, softness, and freshness benefits is a challenge to manufacturers. A formulation including an appearance benefit agent, such as a high-level of cationic polymer, with a fabric softening active, and a freshness agent, such as perfume, may be difficult to manufacture. Resulting compositions may have high viscosity, phase separation, or stability problems, making it impractical for use. These problems may be exacerbated when the molecular weight of the cationic polymer is high and/or when the cationic polymer has a high cationic charge density. High molecular weight cationic polymers can have high viscosities making it difficult for manufacturers to process the polymer. Compositions having high viscosities cannot be easily poured from bottles and cannot readily be dispensed from washing machine dispensers. A potential solution is to lower the molecular weight of the cationic polymer. However, low molecular weight cationic polymers are generally too water soluble and have low deposition on the fabric due to poor retention throughout the wash process. High cationic charge density polymers are effective at forming the coacervate with the anionic carry-over. However, the compositions formed with high cationic charge density polymers may result in stability problems due to depletion flocculation and phase separation. Furthermore, the coacervate formed using high charge density polymers may have large sized particles that can result in a sticky, tacky feel upon drying on fabrics that is unpleasant to consumers.

Therefore, there remains a need to provide a physically stable rinse-added product that provides softness and freshness benefits that also maintains, or even improves, the appearance of clothes.

SUMMARY OF THE INVENTION

A fabric treatment composition comprising a polymer and a fabric softening active, wherein said polymer comprises a cationic repeating unit and a non-cationic repeating unit, wherein said polymer has a weight-average molecular weight of from about 40,000 to about 600,000 Daltons, wherein said polymer has a calculated cationic charge density of from about 0.05 to about 2 meq/g at a pH of between about 2 and about 8, wherein said polymer comprises less than about 0.1% by mole of a cross-linking agent; wherein said fabric softening active comprises a quaternary ammonium compound; and wherein said composition comprises less than about 5% by weight of the composition of an anionic surfactant. A method of treating a fabric comprising the steps of contacting a fabric with a fabric treatment composition.

DETAILED DESCRIPTION OF THE INVENTION

A fabric treatment composition comprising a polymer and a fabric softening active, wherein the composition comprises less than about 5% by weight of the composition of an anionic surfactant. A fabric treatment composition comprising a polymer and a fabric softening active, wherein said polymer comprises a cationic repeating unit and a non-cationic repeating unit, wherein said polymer has a weight-average molecular weight of from about 40,000 to about 600,000 Daltons, wherein said polymer has a calculated cationic charge density of from about 0.05 to about 2 meq/g at a pH of between about 2 and about 8, wherein said polymer comprises less than about 0.1% by mole of a cross-linking agent; wherein said fabric softening active comprises a quaternary ammonium compound; and wherein said composition comprises less than about 5% by weight of the composition of an anionic surfactant.

The fabric treatment compositions disclosed herein can be used during the rinse cycle to deliver softness, and freshness benefits and can also help to maintain, or even improve, the appearance of clothes. These benefits can be provided by selecting particular deposition polymers particular fabric softening actives, and particular perfume systems. Each of these elements is detailed herein. The balance of the composition by weight may be water. In some aspects, the fabric treatment composition may comprise from about 50% to about 95% by weight of the composition of an aqueous liquid carrier. The preferred aqueous carrier is water, which can contain minor ingredients.

Without wishing to be bound by theory, it has surprisingly been found that compositions having cationic polymers having low charge density and a cationic fabric softening active, when combined with anionic carry-over found in the rinse liquor in the washing machine, are effective at forming a separated phase where the resulting composition can be physically stable.

Polymer

The fabric treatment composition may comprise a polymer. The fabric treatment composition may comprise from about 0.5% to about 25% by weight of the composition of a polymer. The fabric treatment composition may comprise from about 1% to about 20% by weight of the composition of a polymer. The fabric treatment composition may comprise from about 2% to about 15% by weight of the composition of a polymer. The fabric treatment composition may comprise from about 2.5% to about 10% by weight of the composition of a polymer.

The polymer may comprise a cationic repeating unit and a non-cationic repeating unit. The cationic repeating unit may be selected from the group consisting of quaternized dimethylaminoethyl acrylate, quaternized dimethylaminoethyl methacrylate, diallyldimethylammonium chloride, vinylimidazole and its quaternized derivatives, methacrylamidopropyltrimethylammonium chloride, and mixtures thereof.

The non-ionic repeating unit may be selected from the group consisting of acrylamide, methacrylamide, acrylic acid, vinyl formamide, vinyl pyrrolidone, vinyl acetate, ethylene oxide, propylene oxide, and mixtures thereof.

The polymer may be a cationic polymer. "Cationic polymer" may mean a polymer having a net cationic charge at a pH of from about 2 to about 8. The cationic polymer may comprise a polymer selected from the group consisting of poly(acrylamide-co-diallyldimethylammonium chloride), poly(acrylamide-co-N,N-dimethyl aminoethyl acrylate) and its quaternized derivatives, poly(acrylamide-co-N,N-dimethylaminoethyl methacrylate) and its quaternized derivatives, poly(diallyldimethylammonium chloride-co-acrylic acid), poly(methylacrylamide-co-dimethylaminoethyl acrylate) and its quaternized derivatives, poly(vinylformamide-co-acrylic acid-co-diallyldimethylammonium chloride), poly(acrylamide-co-acrylic acid-co-diallyldimethylammonium chloride), poly(vinylformamide-co-diallyldimethylammonium chloride), poly(acrylamide-co-acrylic acid-co-diallyldimethylammonium chloride), poly(pyrrolidone-co-methacrylamide-co-vinylimidazole-co-quaternized vinylimidazole), poly(vinylformamide-co-diallyldimethylammonium chloride), poly(vinylpyrrolidone-co-acrylamide-co-vinyl imidazole) and its quaternized derivatives, poly (vinylpyrrolidone-co-methacrylamide-co-vinyl imidazole) and its quaternized derivatives, poly(vinylpyrrolidone-co-vinylacetate-co-diallyldimethylammonium chloride), and mixtures thereof.

The cationic polymer may comprise a polymer selected from the group consisting of poly(diallyldimethylammonium chloride-co-acrylic acid), poly(vinylpyrrolidone-co-acrylamide-co-vinyl imidazole) and its quaternized derivatives, poly(vinylpyrrolidone-co-methacrylamide-co-vinyl imidazole) and its quaternized derivatives, poly(vinylpyrrolidone-co-vinylacetate-co-diallyldimethylammonium chloride) and mixtures thereof.

Without wishing to be bound by theory, a polymer selected from the immediately preceding group may provide the benefit of providing color rejuvenation and maintenance benefits without causing negative tactile effects to the wet or dry feel of the fabric, such as, for example, a wet and/or sticky feel on the fabric.

Without wishing to be bound by theory, it is believed that cationic polymers, when placed into contact with an external source of anionic surfactant and/or cationic surfactant, may form a separated phase where the separated phase formed may have a desirable rheology, particle size, and thermal properties that may provide for color rejuvenation and maintenance benefits to the fabric without causing negative tactile effects to the wet or dry feel of the fabric, such as, for example, a wet and/or sticky feel on the fabric.

The polymer may have a weight-average molecular weight from about 40,000 to about 600,000 Daltons. The polymer may have a weight-average molecular weight from about 50,000 to about 550,000 Daltons. The cationic polymer may have a weight-average molecular weight from about 100,000 to about 500,000 Daltons. Weight-average molecular weight may be determined by size exclusion chromatography relative to polyethyleneoxide standards with RI detection. As used herein, the term "molecular weight" refers to the weight-average molecular weight of the polymer chains in a polymer composition. Further, as used herein, the "weight-average molecular weight" ("Mw") is calculated using the equation:

$$Mw = \frac{(\Sigma iNiMi^2)}{(\Sigma iNiMi)}$$

where Ni is the number of molecules having a molecular weight Mi.

Without wishing to be bound by theory, it is believed that cationic polymers having a weight-average molecular weight of from about 40,000 to about 600,000 Daltons may provide a color rejuvenation benefit to fabric. Without wishing to be bound by theory, it is believed that water soluble cationic polymers having a weight-average molecular weight of less than about 40,000 Daltons may not deposit as readily onto fabric as compared to water soluble cationic polymers of the present disclosure having a weight-average molecular weight of from about 40,000 to about 600,000 Daltons. Without wishing to be bound by theory, water soluble cationic polymers of the present disclosure having a weight-average molecular weight of greater than about 600,000 Daltons may result in undesirable build-up, which may cause, for example, a wet and/or sticky feel, on fabric due to the higher rheology of the high molecular weight polymer.

The cationic polymers of the present disclosure may have a calculated cationic charge density. The cationic polymer may have a calculated cationic charge density of from about 0.05 to about 2 meq/g at a pH of from about 2 to about 8. Without wishing to be bound by theory, it is believed that cationic polymers of the present disclosure having a cationic charge density of from greater than 0.05 to about 2 meq/g when calculated at a pH of from about 2 to about 8 may maintain the stability of the polymer when added to a fabric softening composition with other components such as a perfume. Without wishing to be bound by theory, an upper limit on the cationic charge density of about 2 meq/g at a pH of from about 2 to about 8 may be desired, since the viscosity of a cationic polymer having a cationic charge density that is too high may be difficult to formulate in a composition.

As used herein, the term "calculated cationic charge density" (CCCD) means the amount of net positive charge present per gram of the polymer. CCCD (in units of equivalents of charge per gram of polymer) may be calculated according to the following equation:

$$CCCD = \frac{(Qc \times \text{mol } \%\ c) - (Qa \times \text{mol } \%\ a)}{(\text{mol } \%\ c \times MWc) + (\text{mol } \%\ n \times MWn) + (\text{mol } \%\ a \times MWa)}$$

where: Qc and Qa are the molar equivalents of charge of the cationic, nonionic, and anionic repeat units (if any), respectively; mol % c, mol % n, and mol % a are the molar ratios of the cationic, nonionic, and anionic repeat units (if any), respectively; and MWc, MWn, and MWa are the molecular weights of the cationic, nonionic, and anionic repeat units (if any), respectively. To convert equivalents of charge per gram to milliequivalents of charge per gram (meq/g), multiply equivalents by 1000. If a polymer comprises multiple types of cationic repeat units, multiple types of nonionic repeat units, and/or multiple types of anionic repeat units, the equation can be adjusted accordingly. As used herein "mol %" refers to the relative molar percentage of a particular monomeric structural unit in a polymer. It is understood that within the meaning of the present disclosure, the relative molar percentages of all monomeric structural units that are present in the cationic polymer add up to 100 mol %.

By way of example, a cationic homopolymer (molar ratio=100% or 1.00) having a monomer molecular weight of 161.67 g/mol, the CCCD is calculated as follows: polymer charge density is [(1)×(1.00)/(161.67)]×1000=6.19 meq/g. A copolymer having a cationic monomer with a molecular weight of 161.67 g/mol and a neutral co-monomer having a molecular weight of 71.079 g/mol in a mol ratio of 1:1 is calculated as (1×0.50)/[(0.50×161.67)+(0.50×71.079)]×1000=4.3 meq/g. A terpolymer having a cationic monomer having a molecular weight of 161.67, a neutral co-monomer having a molecular weight of 71.079 g/mol, and an anionic co-monomer having a neutralized molecular weight of 94.04 g/mol in a mol ratio of 20:75:5 has a CCCD of 1.7 meq/g.

In one aspect, the cationic polymer may be poly(pyrrolidone-co-methacrylamide-co-vinylimidazole-co-quaternized vinylimidazole) and may have a cationic calculated charge density of about 0.6 meq/g.

The cationic polymer may comprise charge neutralizing anions such that the overall polymer is neutral under ambient conditions. Suitable counter ions include (in addition to anionic species generated during use) chloride, bromide, sulfate, methylsulfate, sulfonate, methylsulfonate, carbonate, bicarbonate, formate, acetate, citrate, nitrate, and mixtures thereof.

The cationic polymer may comprise less than about 0.1% by mole of a cross-linking agent. The cationic polymer may comprise less than about 0.05% by mole of a cross-linking agent. The cationic polymer may comprise less than about 0.01% by mole of a cross-linking agent. The cross-linking agent may contain at least two ethylenically unsaturated moieties. The cross-linking agent may contain at least two or more ethylenically unsaturated moieties. The cross-linking agent may contain at least three or more ethylenically unsaturated moieties.

Typical cross-linking agents include divinyl benzene, tetraallylammonium chloride; allyl acrylates; allyl acrylates and methacrylates, diacrylates and dimethacrylates of glycols and polyglycols, allyl methacrylates; and tri- and tetramethacrylates of polyglycols; or polyol polyallyl ethers such as polyallyl sucrose or pentaerythritol triallyl ether, butadiene, 1,7-octadiene, allyl-acrylamides and allyl-methacrylamides, bisacrylamidoacetic acid, N,N'-methylenebisacrylamide and polyol polyallylethers, such as polyallylsaccharose and pentaerythrol triallylether, ditrimethylolpropane tetraacrylate, pentaerythrityl tetraacrylate, pentaerythrityl tetraacrylate ethoxylated, pentaerythrityl tetramethacrylate, pentaerythrityl triacrylate, pentaerythrityl triacrylate ethoxylate, triethanolamine trimethacrylate, 1,1,1-trimethylolpropane triacrylate, 1,1,1-trimethylolpropane triacrylate ethoxylate, trimethylolpropane tris(polyethylene glycol ether) triacrylate, 1,1,1-trimethylolpropane trimethacrylate, tris-(2-hydroxyethyl)-1,3,5-triazine-2,4,6-trione triacrylate, tris-(2-hydroxyethyl)-1,3,5-triazine-2,4,6-trione trimethacrylate, dipentaerythrityl pentaacrylate, 3-(3-{[dimethyl-(vinyl)-silyl]-oxy}-1,1,5,5-tetramethyl-1,5-divinyl-3-trisiloxanyl)-propyl methacrylate, dipentaerythritol hexaacrylate, 1-(2-propenyloxy)-2,2-bis[(2-propenyloxy)-methyl]-butane, trimethacrylic acid-1,3,5-triazin-2,4,6-triyl-tri-2,1-ethandiyl ester, glycerine triacrylate propoxylate, 1,3,5-triacryloylhexahydro-1,3,5-triazine, 1,3-dimethyl-1,1,3,3-tetravinyldisiloxane, pentaerythrityl tetravinyl ether, 1,3-dimethyl-1,1,3,3-tetravinyldisiloxane, (Ethoxy)-trivinylsilane, (Methyl)-trivinylsilane, 1,1,3,5,5-pentamethyl-1,3,5-trivinyltrisiloxane, 1,3,5-trimethyl-1,3,5-trivinylcyclotrisilazane, 2,4,6-trimethyl-2,4,6-trivinylcyclotrisiloxane, 1,3,5-trimethyl-1,3,5-trivinyltrisilazane, tris-(2-butanone oxime)-vinylsilane, 1,2,4-trivinylcyclohexane, trivinylphosphine, trivinylsilane, methyltriallylsilane, pentaerythrityl triallyl ether, phenyltriallylsilane, triallylamine, triallyl citrate, triallyl phosphate, triallylphosphine, triallyl phosphite, triallylsilane, 1,3,5-triallyl-1,3,5-triazine-2,4,6(1H,3H,5H)-trione, trimellitic acid triallyl ester, trimethallyl isocyanurate, 2,4,6-tris-(allyloxy)-1,3,5-triazine, 1,2-Bis-(diallylamino)-ethane, pentaerythrityl tetratallate, 1,3,5,7-tetravinyl-1,3,5,7-tetramethylcyclotetrasiloxane, 1,3,5,7-tetravinyl-1,3,5,7-tetramethylcyclotetrasiloxane, tris-[2-acryloyloxy)-ethyl]-phosphate, vinylboronic anhydride pyridine, 2,4,6-trivinylcyclotriboroxanepyridine, tetraallylsilane, tetraallyloxysilane, 1,3,5,7-tetramethyl-1,3,5,7-tetravinylcyclotetrasilazane. Preferred compounds may be selected from the group consisting of alkyltrimethylammonium chloride, pentaerythrityl triacrylate, pentaerythrityl tetraacrylate, tetrallylammonium chloride, 1,1,1-trimethylolpropane tri (meth)acrylate, and mixtures thereof. These preferred compounds can also be ethoxylated. The cross-linking agents may be selected from the group consisting of tetraallyl ammonium chloride, allyl-acrylamides and allyl-methacrylamides, bisacrylamidoacetic acid, and N,N'-methylene-bisacrylamide, and mixtures thereof. The cross-linking agent may be tetraallyl ammonium chloride. The cross-linking agent may be selected from the group consisting of pentaerythrityl triacrylate, pentaerythrityl tetraacrylate, and mixtures thereof.

Fabric Softening Active

The fabric treatment composition may comprise a fabric softening active. The fabric treatment composition may comprise from about 1% to about 49% by weight of the composition of a fabric softening active, specifically reciting all 1% increments within the specified ranges and all ranges formed therein or thereby. The fabric treatment composition may comprise from about 5% to about 30% by weight of the composition of a fabric softening active. The fabric treatment composition may comprise from about 8% to about 20% by weight of the composition of a fabric softening active.

Suitable fabric softening actives are described below.

Form

The fabric softening active may be formed as part of a softener composition. The softener composition may take any suitable form, such as liquid, gel, or foam. The softener composition can be a liquid. In some aspects, the softener composition may comprise from about 50% to about 95%. The softener composition may comprise from about 60% to about 95%. The softener composition may comprise from about 70% to about 95%, by weight of the softener composition of an aqueous liquid carrier. The aqueous carrier can be water, which may contain minor ingredients.

The softener composition may comprise from about 2% to about 30% by weight of the total softener composition of one or more fabric softening actives, specifically reciting all 1% increments within the specified ranges and all ranges formed therein or thereby. In one aspect, the softener composition may comprise from about 3% to about 25% by weight of the total softener composition of one or more fabric softening actives. In one aspect, the softener composition may comprise from about 5% to about 20% by weight of the total softener composition of one or more fabric softening actives.

Suitable commercially available fabric softeners may also be used, such DOWNY® and LENOR®, manufactured by The Procter & Gamble Company, Cincinnati, Ohio, USA, as well as SNUGGLE®, manufactured by The Sun Products Corporation, Wilton, Conn., USA.

Fabric Softening Active

The term "fabric softening active" is used herein in the broadest sense to include any active that is suitable for softening a fabric.

The fabric softening active may comprise a quaternary ammonium compound suitable for softening fabric in a rinse step. The fabric softening active may be formed from a reaction product of a fatty acid and an aminoalcohol obtaining mixtures of mono-, di-, and tri- ester compounds. The fabric softening active may comprise one or more softener quaternary ammonium compounds selected from the group consisting of monoalkylquaternary ammonium compounds, dialkylquaternary ammonium compounds, trialkyl quaternary ammonium compounds, diamido quaternary compounds, diester quaternary ammonium compounds, monoester quaternary ammonium compounds and mixtures thereof.

The quaternary ammonium compound may comprise an alkyl quaternary ammonium compound selected from the group consisting of monoalkyl quaternary ammonium compounds, a dialkyl quaternary ammonium compounds, a trialkyl quaternary ammonium compounds, and mixtures thereof. The fabric softening active may comprise a quaternary ammonium compound selected from the group consisting of linear quaternary ammonium compounds, branched quaternary ammonium compounds, cyclic quaternary ammonium compounds, and mixtures thereof. The quaternary ammonium compound may be selected from the group consisting of alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

The quaternary ammonium compounds may comprise one or more fatty acid moieties having an average chain length of from about 10 to about 22 carbon atoms and an iodine value of from 0 to about 95, specifically reciting all 1.0 number increments within the specified iodine value range and all ranges formed therein or thereby. The quaternary ammonium compounds may comprise one or more fatty acid moieties having an average chain length of from about 10 to about 22 carbon atoms and an iodine value of from about 0.5 to about 60. The quaternary ammonium compounds may comprise one or more fatty acid moieties having an average chain length of from about 14 to about 18 carbon atoms and an iodine value of from 0 to about 95. The quaternary ammonium compounds may comprise one or more fatty acid moieties having an average chain length of from about 14 to about 18 carbon atoms and an iodine value of from about 0.5 to about 60. The quaternary ammonium compounds may comprise one or more fatty acid moieties having an average chain length of from about 14 to about 18 carbon atoms and an iodine value of from about 10 to about 30. The quaternary ammonium compounds may comprise one or more fatty acid moieties having an average chain length of from about 14 to about 16 carbon atoms and an iodine value of from about 0.5 to about 60. The quaternary ammonium compounds may comprise one or more fatty acid moieties having an average chain length of from about 14 to about 16 carbon atoms and an iodine value of from about 10 to about 30. As used herein, the Iodine Value (IV) is the amount of iodine in grams consumed by the reaction of the double bonds of 100 g of fatty acid, determined by the method of ISO 3961.

The quaternary ammonium compounds may comprise one or more moieties selected from the group consisting of alkyl moieties, ester moieties, amide moieties, ether moieties, and mixtures thereof, wherein one or more moieties may be covalently bound to the nitrogen of the quaternary ammonium compound.

In an aspect, the quaternary ammonium compound may be selected from the group consisting of bis-(2-hydroxyethyl)-dimethylammonium methylsulfate fatty acid ester, bis-(2-hydroxyethyl)-dimethylammonium chloride fatty acid ester, bis-(2-hydroxypropyl)-dimethylammonium methylsulphate fatty acid ester, bis-(2-hydroxypropyl-dimethylammonium chloride fatty acid ester, and mixtures thereof. The quaternary ammonium compound may comprise one or more fatty acid moieties having an average chain length of from about 16 to about 18 carbon atoms and an iodine value of from 0.5 to 60.

The fabric softening active may comprise compounds of the following formula:

$$\{R_{4-m}-N+-[Z-Y-R^1]_n\}A^- \quad (1)$$

wherein each R may comprise either hydrogen, a short chain $C_1$-$C_6$ alkyl or hydroxyalkyl group, a $C_1$-$C_3$ alkyl or hydroxyalkyl group, for example methyl, ethyl, propyl, hydroxyethyl, and the like, poly($C_{2-3}$ alkoxy), polyethoxy, benzyl, and mixtures thereof; each Z is independently $(CH_2)$ n, $CH_2$-$CH(CH_3)$— or CH-$(CH_3)$-$CH_2$—; each Y may comprise —O—(O)C—, —C(O)—O—, —NR—C(O)—, or —C(O)—NR—; each m is 2 or 3; each n is from 1 to about 3, preferably 2; the sum of carbons in each $R^1$, plus one when Y is —O—(O)C— or —NR—C(O)—, may be $C_{12}$-$C_{22}$, or $C_{14}$-$C_{20}$, with each $R^1$ being a hydrocarbyl, or substituted hydrocarbyl group; and $A^-$ may comprise any softener-compatible anion. The softener-compatible anion may comprise chloride, bromide, methylsulfate, ethylsulfate, sulfate, and nitrate. The softener-compatible anion may comprise chloride or methyl sulfate. As used herein, when the diester is specified, it may include the monoester that is present.

The fabric softening active may comprise a diester quaternary amine (DEQA) of the general formula:

$$[R_3N^+CH_2CH(YR^1)(CH_2YR^1)]A^-$$

wherein each Y, R, $R^1$, and $A^-$ has the same meanings as above. Such compounds include those having the formula:

$$[CH_3]_3N^{(+)}[CH_2CH(CH_2O(O)CR^1)O(O)CR^1]Cl^{(-)} \quad (2)$$

wherein each R may comprise a methyl or ethyl group. In an aspect, each $R^1$ may comprise a $C_{15}$ to $C_{19}$ group. As used herein, when the diester is specified, it may include the monoester that is present.

Examples of types of fabric softening active agents and general methods of making them are disclosed in U.S. Pat. No. 4,137,180. An example of a suitable DEQA (2) is the "propyl" ester quaternary ammonium fabric softener active comprising the formula 1,2-di(acyloxy)-3-trimethylammoniumpropane chloride.

The fabric softening active may comprise compounds of the formula:

$$[R_{4-m}-N^+-R^1{}_m]A^- \quad (3)$$

wherein each R, $R^1$, m and $A^-$ has the same meanings as above.

In some aspects, the fabric softening active may comprise compounds of the formula:

(4)

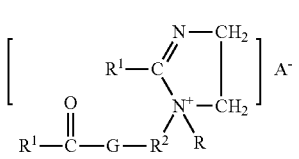

wherein each R, $R^1$, and $A^-$ have the definitions given above; $R^2$ may comprise a $C_{1-6}$ alkylene group, preferably an ethylene group; and G may comprise an oxygen atom or an —NR— group; and A—may be chloride, bromide, iodide, methylsulfate, ethylsulfate, acetate, formate, sulfate, carbonate, and the like.

The fabric softening active may comprise compounds of the formula:

(5)

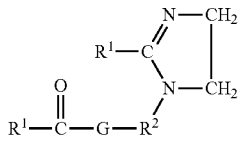

wherein $R^1$, $R^2$ and G are defined as above.

The fabric softening active may comprise condensation reaction products of fatty acids with dialkylenetriamines in, for example, a molecular ratio of about 2:1, the reaction products containing compounds of the formula:

$$R^1—C(O)—NH—R^2—NH—R^3—NH—C(O)—R^1 \quad (6)$$

wherein $R^1$, $R^2$ are defined as above, and $R^3$ may comprise a $C_{1-6}$ alkylene group, preferably an ethylene group and wherein the reaction products may optionally be quaternized by the additional of an alkylating agent such as dimethyl sulfate. Examples of such quaternized reaction products are described in additional detail in U.S. Pat. No. 5,296,622.

The fabric softening active may comprise compounds of the formula:

$$[R^1—C(O)—NR—R^2—N(R)_2—R^3—NR—C(O)—R^1]^+A^- \quad (7)$$

wherein R, $R^1$, $R^2$, $R^3$ and $A^-$ are defined as above.

The fabric softening active may comprise reaction products of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad (8)$$

wherein $R^1$, $R^2$ and $R^3$ are defined as above;

The fabric softening active may comprise compounds of the formula:

(9)

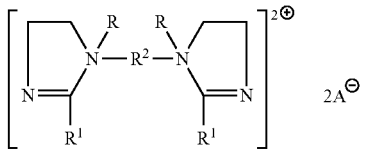

wherein R, $R^1$, $R^2$, and $A^-$ are defined as above.

The fabric softening active may comprise compounds of the formula:

(10)

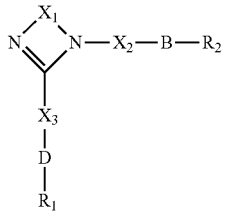

wherein $X_1$ is a C2-3 alkyl group, preferably an ethyl group; $X_2$ and $X_3$ are independently C1-6 linear or branched alkyl or alkenyl groups, preferably methyl, ethyl or isopropyl groups;

$R_1$ and $R_2$ are independently C8-22 linear or branched alkyl or alkenyl groups;

characterized in that B and D are independently selected from the group comprising —O—(C═O)—, —(C═O)—O—, and mixtures thereof, preferably —O—(C═O)—.

Non-limiting examples of fabric softening actives comprising formula (1) may include N, N-bis(stearoyl-oxy-ethyl)-N,N-dimethyl ammonium chloride, N,N-bis(tallowoyl-oxy-ethyl)-N,N-dimethyl ammonium chloride, N,N-bis-(stearoyl-2-hydroxypropyl)-N,N-dimethylammonium methylsulphate, N,N-bis-(tallowoyl-2-hydroxypropyl)-N,N-dimethylammonium methylsulphate, N,N-bis-(palmitoyl-2-hydroxypropyl)-N,N-dimethylammonium methylsulphate, N,N-bis-(stearoyl-2-hydroxypropyl)-N,N-dimethylammonium chloride, and N,N-bis(stearoyl-oxy-ethyl)-N-(2 hydroxyethyl)-N-methyl ammonium methylsulfate.

Non-limiting examples of fabric softening actives comprising formula (2) may include 1, 2 di (stearoyl-oxy) 3 trimethyl ammoniumpropane chloride.

Non-limiting examples of fabric softening actives comprising formula (3) may include dialkylenedimethylammonium salts such as dicanoladimethylammonium chloride and di(hard)tallowdimethylammonium chloride dicanoladimethylammonium methylsulfate. An example of commercially available dialkylenedimethylammonium salts usable in the present disclosure is dioleyldimethylammonium chloride available under the trade name ADOGEN® 472, manufactured by Evonik Industries, Essen, Germany, and dihardtallow dimethylammonium chloride available under the trade name ARQUAD® 2HT-75, manufactured by AkzoNobel, Amsterdam, Netherlands.

A non-limiting example of a fabric softening active comprising formula (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion available under the tradename VARISOFT®, manufactured by Evonik Industries, Essen, Germany.

A non-limiting example of a fabric softening active comprising formula (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of a fabric softening active comprising formula (6) is the reaction products of fatty acids with diethylenetriamine in a molecular ratio of about 2:1, the reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$ is an alkyl group of a commercially available fatty acid derived from a vegetable or animal source, such as those available under the trade names EMERSOL® 223LL or EMERSOL® 7021, manufactured by Henkel Corporation, Dusseldorf, Germany, and $R^2$ and $R^3$ are divalent ethylene groups.

A non-limiting example of a fabric softening active comprising formula (7) is a difatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4—$$

wherein $R^1$ is an alkyl group. An example of such compound is that commercially available under the tradename VARISOFT® 222LT, manufactured by Evonik Industries, Essen, Germany.

An example of a fabric softening active comprising formula (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as those available under the tradenames EMERSOL® 223LL or EMERSOL® 7021, manufactured by Henkel Corporation, Dusseldorf, Germany.

An example of a fabric softening active comprising formula (9) is the diquaternary compound having the formula:

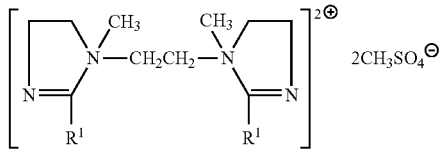

wherein $R^1$ is derived from fatty acid.

A non-limiting example of a fabric softening active comprising formula (10) is a dialkyl imidazoline diester compound, where the compound is the reaction product of N-(2-hydroxyethyl)-1,2-ethylenediamine or N-(2 -hydroxyis opropyl)- 1, 2- ethylenediamine with glycolic acid, esterified with fatty acid, where the fatty acid is (hydrogenated) tallow fatty acid, palm fatty acid, hydrogenated palm fatty acid, oleic acid, rapeseed fatty acid, hydrogenated rapeseed fatty acid or a mixture of the above.

It will be understood that combinations of fabric softening actives disclosed above are suitable for use in this invention.

Anion A

In the cationic nitrogenous salts described herein, the anion $A^-$, which may comprise any softener compatible anion, provides electrical neutrality. The anion used to provide electrical neutrality in these salts may be from a strong acid, e.g., a halide, such as chloride, bromide, or iodide. However, other anions can be used, such as methylsulfate, ethylsulfate, acetate, formate, sulfate, carbonate, and the like. In an aspect, the anion A— may comprise chloride or methylsulfate. The anion A— may carry a double charge. The anion A— may represent half a group.

Softener Adjuncts

The softener composition may comprise one or more softener adjuncts. The softener composition may comprise a softener adjunct selected from the group consisting of a salt, a cationic polymer, perfume and/or a perfume delivery system and mixtures thereof.

The softener composition may comprise from about 0% to about 0.75% by weight of the total softener composition, of a salt. The softener composition may comprise from about 0.01% to about 0.2% by weight of the total softener composition, of a salt. The softener composition may comprise from about 0.02% to about 0.1% by weight of the total softener composition, of a salt. The softener composition may comprise from about 0.03% to about 0.075% by weight of the total softener composition, of a salt. The salt may be selected from the group consisting of sodium chloride, potassium chloride, calcium chloride, magnesium chloride and mixtures thereof.

The softener compositions described herein may comprise other softener adjunct ingredients, for example a softener adjunct ingredient selected from the group consisting of solvents, chelating agents, dye transfer inhibiting agents, dispersants, polymeric dispersing agents, clay soil removal/anti-redeposition agents, brighteners, suds suppressors, dyes, perfume, benefit agent delivery systems, structure elasticizing agents, carriers, hydrotropes, processing aids and/or pigments, cationic starches, scum dispersants, dye, hueing agent, optical brighteners, antifoam agents, stabilizer, pH control agent, metal ion control agent, odor control agent, preservative, antimicrobial agent, chlorine scavenger, anti-shrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, drying agent, stain resistance agent, soil release agent, malodor control agent, fabric refreshing agent, dye fixative, color maintenance agent, color restoration/rejuvenation agent, anti-fading agent, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, and mixtures thereof.

Silicone

The fabric treatment composition may further comprise a silicone. The silicone may be selected from the group consisting of cyclic silicones, polydimethylsiloxanes, aminosilicones, cationic silicones, anionic silicones, silicone polyethers, silicone resins, silicone urethanes, and mixtures thereof. Without wishing to be bound by theory, it is believed that silicones of the immediately preceding list when added to a composition containing a polymer and a fabric softening active, provide the benefit of lubricating the fabrics to give a soft and/or lubricious feel.

Perfume and Perfume Delivery Technology

The fabric treatment composition may comprise from about 0.1% to about 20% by weight of the composition of a perfume. The fabric treatment composition may comprise less than about 0.1% by weight of the composition of a perfume. Without wishing to be bound by theory, encapsulated perfumes can enhance the fabric treatment experience by improving perfume release by depositing onto fabrics and later rupturing, resulting in greater scent intensity and noticeability. Perfume ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise complex mixtures of such ingredients. The fabric treatment composition may comprise a perfume raw material having a ClogP of less than or equal to about 3.

The fabric treatment composition may comprise raw materials selected from the group consisting of melonal, dihydro myrcenol, freskomenthe, tetra hydro linalool, linalool, anisic aldehyde, citronellol, ionone beta, ionone alpha, geraniol, delta damascone, thio-damascone, bourgeonal, cymal, alpha damascone, ethyl linalool, lilial, ionone gamma methyl, helional, cashmeran, vanillin, amyl salicylate, ethyl vanillin, calone, iso e super, hexyl salicylate, galaxolide, nectaryl, benzyl salicylate, trichloromethyl phenyl carbinyl acetate, β-Damascenone, dihydro beta ionone, ligustral, triplal, beta naphthol methyl ether, and mixtures thereof.

In one aspect, the fabric treatment composition may comprise a perfume comprising thio-damascone, such as, for example, HALOSCENT® D made available by Firmenich, Geneva, Switzerland. Perfumes comprising thio-damascone may deliver provide prolonged perfume release by delivery of a high impact accord (HIA) perfume ingredient that may deposit readily onto fabrics.

The fabric treatment compositions disclosed herein may comprise a perfume selected from the group consisting of an encapsulated perfume, an unencapsulated perfume, and mixtures thereof.

The term "unencapsulated perfume" is used herein in the broadest sense and may mean a composition comprising free perfume ingredients wherein the free perfume ingredients are neither absorbed onto or into a perfume carrier (e.g., absorbed on to zeolites or clays or cyclodextrin) nor encapsulated (e.g., in a perfume encapsulate). An unencapsulated perfume ingredient may also comprise a pro-perfume, provided that the pro-perfume is neither absorbed nor encapsulated. Non-limiting examples of suitable perfume ingredients include blooming perfumes, perfume oils, and perfume raw materials comprising alcohols, ketones, aldehydes, esters, ethers, nitriles alkenes, and mixtures thereof. Non-limiting examples of blooming perfume ingredients that may be useful in the products of the present disclosure are given in U.S. Patent Publication 2005/0192207 A1.

The term "encapsulated perfume" is used herein in the broadest sense and may include the encapsulation of perfume or other materials or actives in small capsules (i.e., encapsulates), typically having a diameter less than about 100 microns. These encapsulates may comprise a spherical outer shell containing water insoluble or at least partially water insoluble material, typically polymer material, within which the active material, such as perfume, is contained.

The encapsulated perfume may have a shell, which may at least partially surround the core. The shell may include a shell material selected from the group consisting of polyethylenes; polyamides; polystyrenes; polyisoprenes; polycarbonates; polyesters; polyacrylates; acrylics; aminoplasts; polyolefins; polysaccharides, such as alginate and/or chitosan; gelatin; shellac; epoxy resins; vinyl polymers; water insoluble inorganics; silicone; and mixtures thereof. The shell material may be selected from the group consisting of an aminoplast, an acrylic, an acrylate, and mixtures thereof.

The shell material may include an aminoplast. The aminoplast may include a polyurea, polyurethane, and/or polyurea/urethane. The aminoplast may include an aminoplast copolymer, such as melamine-formaldehyde, urea-formaldehyde, cross-linked melamine formaldehyde, and mixtures thereof. The shell material may include melamine formaldehyde, and the shell may further include a coating as described below. The encapsulated perfume may include a core that comprises perfume, and a shell that includes melamine formaldehyde and/or cross linked melamine formaldehyde. The encapsulated perfume may include a core that comprises perfume, and a shell that comprises melamine formaldehyde and/or cross linked melamine formaldehyde, poly(acrylic acid) and poly(acrylic acid-co-butyl acrylate).

The outer wall of the encapsulated perfume may include a coating. Certain coatings may improve deposition of the encapsulated perfume onto a target surface, such as a fabric. The encapsulated perfume may have a coating-to-wall weight ratio of from about 1:200 to about 1:2, or from about 1:100 to about 1:4, or even from about 1:80 to about 1:10.

The coating may comprise a polymer. The coating may comprise a cationic polymer. The cationic polymer may be selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, pollyallyl amines, copolymers thereof, and mixtures thereof. The coating may comprise a polymer selected from the group consisting of polyvinyl amines, polyvinyl formamides, polyallyl amines, copolymers thereof, and mixtures thereof.

The coating may comprise polyvinyl formamide The polyvinyl formamide may have a hydrolysis degree of from about 5% to about 95%, from about 7% to about 60%, or even from about 10% to about 40%.

In one aspect, the perfume may be an encapsulated perfume having a shell, wherein the shell may comprise a material selected from the group consisting of aminoplast copolymer, melamine formaldehyde or urea-formaldehyde or cross-linked melamine formaldehyde, an acrylic, an acrylate and mixtures thereof. In one aspect, the perfume may be an encapsulated perfume having a shell, wherein the shell may comprise a material selected from the group consisting of melamine formaldehyde, cross-linked polyacrylate, polyurea, polyurethanes, and mixtures thereof.

The encapsulated perfume may comprise a friable perfume encapsulate. Friability refers to the propensity of the encapsulate to rupture or break open when subjected to direct external pressures or shear forces. As disclosed herein, an encapsulate is "friable" if, while attached to fabrics treated therewith, the encapsulate can be ruptured by the forces encountered when the capsule-containing fabrics are manipulated by being worn or handled (thereby releasing the contents of the capsule). Friable perfume encapsulates can be attractive for use in fabric treatment compositions because not only do the friable perfume encapsulates enable top-note scent characters to deposit easily onto fabrics during the fabric treatment process, but they also allow the consumer to experience these scent types throughout the day while wearing their article of clothing. Friable perfume encapsulates rupture and release perfume by a mechanical means (e.g., friction), not a chemical means (e.g., water hydrolysis). Minimal fracture pressure is typically needed to break the structure such as normal everyday physical movements such as taking off a jacket; pulling a shirt off; or taking off/putting on socks. Non-limiting examples of perfume encapsulates suitable as an encapsulated perfume are available in the following references: U.S. Pat. Nos. and Publications 6,645,479; 6,200,949; 4,882,220; 4,917,920; 4,514,461; 4,234,627; 2003/215417 A1; 2003/216488 A1; 2003/158344 A1; 2003/165692 A1; 2004/071742 A1; 2004/071746 A1; 2004/072719 A1; 2004/072720 A1; 2003/203829 A1; 2003/195133 A1; 2004/087477 A1; 2004/0106536 A1 and EP Patent Publication 1393706 A1. The perfume encapsulate may encapsulate a blooming perfume composition, wherein the blooming perfume composition comprises blooming perfume ingredients.

The perfume may be added to the polymer as an emulsion.

Surfactant

The fabric treatment composition may further comprise a nonionic surfactant. The fabric treatment system may comprise from about 0.1% to about 8% by weight of the composition of a nonionic surfactant, specifically reciting all 1% increments within the specified ranges and all ranges formed therein or thereby. The composition may comprise less than about 5% by weight of the composition of an anionic surfactant. The composition may be substantially free of anionic surfactant. In one aspect, the fabric composition may comprise from about 0.1% to about 6% by weight of the composition of a nonionic surfactant. In one aspect, the fabric composition may comprise from about 0.5% to about 5% by weight of the composition of a nonionic surfactant. Without wishing to be bound by theory, when the perfume is added to the fabric softening composition, the perfume may not be stable within the fabric softening composition. To stabilize the perfume, a nonionic surfactant may be added to the fabric softening composition.

For the purposes of the present disclosure, nonionic surfactants may be defined as substances having molecular structures having a hydrophilic and a hydrophobic part. The hydrophobic part consists of a hydrocarbon and the hydrophilic part of a strongly polar group. The nonionic surfactants of the present disclosure may be soluble in water. Without wishing to be bound by theory, nonionic surfactants may emulsify the perfume within fabric softening compositions.

The fabric treatment composition may comprise a nonionic surfactant selected from the group consisting of alkoxylated compounds, ethoxylated, compounds, carbohydrate compounds, and mixtures thereof. Without wishing to be bound by theory, such alkoxylated, ethoxylated, and carbohydrate compounds may emulsify the perfume within the high cationic polymer fabric treatment composition.

The fabric treatment composition may comprise less than about 5% by weight of the composition of an anionic surfactant. The fabric treatment composition may comprise less than about 1.5% by weight of the composition of an anionic surfactant. The composition may be substantially free of anionic surfactant. As used herein, "substantially free of a component" refers to the complete absence of a component,a minimal amount thereof merely as impurity or unintended byproduct of another component and that no amount of that component is deliberately incorporated into the composition, or a non-functional amount.

Without wishing to be bound by theory fabric color can appear faded or dull after laundering due to fabric to fabric abrasion that occurs during the wash process. This abrasive damage can lead to fibers loosening, and fibrils or fuzz being formed. Protruding fibers or fibrils can scatter light, and can produce an optical effect of diminished color intensity. One way to maintain, or improve, the color on damaged fabrics can be via water insoluble, hydrophobic particles formed from cationic polymer and anionic surfactant via a coacervate. As used herein, a "coacervate" means a particle formed from the association of a cationic polymer and an anionic surfactant in an aqueous environment. These hydrophobic particles can deposit on the fabric surface to prevent abrasion, and they can reset fibers or fibrils on damaged fabrics. Resetting the fibers or fibrils is believed to result in smoother yarns, thereby reducing the number of fibers or fibrils protruding from the fabric surface. As a result, there can be less light scattering from the fabric and a more intense color can be perceived by the consumer.

In addition to providing the color benefit via coacervate formation, high levels of cationic polymer that are in excess of the anionic carryover in the rinse liquor can deliver the desired appearance benefit on fabrics by resetting fibers or fibrils when they go through a tacky phase upon drying on the fiber.

Suds Suppressor

The fabric treatment composition may comprise from about 0.01% to about 1% by weight of the composition of a suds suppressor. In one aspect, the fabric treatment composition may comprise from about 0.05% to about 0.5% by weight of the composition of a suds suppressor. In one aspect, the fabric treatment composition may comprise from about 0.1% to about 0.5% by weight of the composition of a suds suppressor. Without wishing to be bound by theory, nonionic surfactants, when added to the fabric treatment composition having cationic polymer and perfume, may act to stabilize the fabric treatment composition. However, this in turn may create a stable foam or sudsing. Foam or sudsing is undesirable to consumers in a rinse additive in a washing machine as such foam or suds may not fully rinse and some foam or suds may remain on the garments. As such, the fabric treatment composition may comprise a suds suppressor. Without wishing to be bound by theory, a composition having greater than about 0.05% by weight of the composition of a suds suppressor may provide the benefit of lessening product foaming during use.

The suds suppressor may be silicone-based. In one aspect, the fabric treatment composition may comprise from about 0.01% to about 1% by weight of the composition of an organosilicone. The fabric treatment composition may comprise from about 0.05% to about 0.5% by weight of the composition of an organosilicone. The fabric treatment composition may comprise from about 0.1% to about 0.5% by weight of the composition of an organosilicone. Suitable organosilicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In one aspect, suitable organosilicones may have a viscosity of from about 10 to about 800,000 centistokes at 25° C. Suitable organosilicones may be linear, branched or cross-linked. In one aspect, the organosilicones may be linear. A conventional suds suppressor system used in fabric treatment compositions may be based on polydimethylsiloxane and hydrophobized silica.

Examples of a suitable suds suppressor include those available under the trade name DOW CORNING® Antifoam 2310, made available by Dow Corning Corporation, Midland, Michigan, United States. X DOW CORNING® Antifoam 2310 is a highly efficient suds suppressor and defoamer at low concentration levels. DOW CORNING® Antifoam 2310 is easily dispersed within aqueous systems such as within the fabric treatment composition of the present disclosure. DOW CORNING® Antifoam 2310 is commonly used to suppress sudsing and to defoam in the applications of many liquid detergent and liquid fabric enhancer products.

Structuring System

The fabric treatment composition of the present disclosure may include an external structuring system. External structurants provide a structuring benefit independently from, or extrinsic from, any structuring effect of surfactants in the composition. Silicone, such as organosilicone when used as a suds suppressor, is not water soluble. A silicone-based suds suppressor may need to be suspended within the fabric treatment composition. As such, an external structuring system may be used to provide sufficient shear thinning viscosity to the composition in order to provide, for example, suitable pour viscosity, phase stability, and/or suspension capabilities. The external structuring system may be particularly useful for suspending the organosilicone-based suds suppressor and/or the encapsulates.

The fabric treatment composition may comprise from about 0.03% to about 1% by weight of the composition of an external structuring system. The fabric treatment composition may comprise from about 0.06% to about 1% by weight of the composition of an external structuring system.

The external structuring system may be of nonionic, anionic, or cationic nature. External structuring systems of nonionic nature may avoid undesirable interactions that external structuring systems of anionic and/or of cationic nature experience given that external structuring systems of nonionic nature show little interaction with the actives in the fabric treatment composition. Without wishing to be bound by theory, external structuring systems of anionic nature may form a precipitate or complex with the cationic polymer in the fabric treatment composition of the present disclosure which lowers the physical stability of the fabric treatment composition. For example, the external structuring system may comprise xanthan gum. However, without wishing to be bound by theory, xanthan gum may not be ideal because xanthan gum is slightly anionic in nature, and xanthan gum may not be stable in the long-term over a broad temperature range because it may form a precipitate or complex that is not stable. Structurants that are highly anionic in nature such as, for example, hydrogenated castor oil in mixtures with anionic surfactants such as linear alkyl benzene sulfonate and alkyl ethoxylated sulfate, are also not ideal because they may more readily form a precipitate or complex with the cationic polymer in the fabric treatment composition of the present disclosure. External structurants of cationic nature such as, for example, cross-linked cationic polymers, are known in the art to be structurants. External structurants of nonionic nature and/or of cationic nature may help to avoid such phase instability by having little interaction with the actives in the fabric treatment composition of the present disclosure.

The external structuring system may comprise a structurant selected from the group consisting of microfibrillated cellulose, cross-linked cationic polymers, triglycerides, polyacrylates, and mixtures thereof.

The fabric treatment composition may comprise from about 0.03% to about 1% by weight of the composition of a naturally derived and/or synthetic polymeric structurant. Suitable cellulose fibers may comprise fibers having an aspect ratio (length to width ratio) from about 50 to about 100,000, optionally from about 300 to about 10,000, and may be selected from the group consisting of mineral fibers, fermentation derived cellulose fibers, fibers derived from mono- or di-cotyledons such as vegetables, fruits, seeds, stem, leaf and/or wood derived cellulose fibers, and mixtures thereof.

In one aspect, the external structuring system may comprise microfibrillated cellulose derived from vegetables or wood. In one aspect, the microfibrillated cellulose may comprise a material selected from the group consisting of sugar beet, chicory root, food peels, and mixtures thereof. The microfibrillated cellulose may be a fermentation derived cellulose.

Microfibrillated cellulose (MFC) derived from vegetables or wood, has been found to be suitable for use as an external structurant, for liquid compositions comprising at least one surfactant. Suitable vegetables, from which the MFC can be derived, may include, but are not limited to: sugar beet, chicory root, potato, carrot, and other such carbohydrate-rich vegetables. Vegetables or wood can be selected from the group consisting of: sugar beet, chicory root, and mixtures thereof. Vegetable and wood fibers comprise a higher proportion of insoluble fiber than fibers derived from fruits, including citrus fruits. Preferred MFC are derived from vegetables and woods which comprise less than about 10% soluble fiber as a percentage of total fiber. Suitable processes for deriving MFC from vegetables and wood include the process described in U.S. Pat. No. 5,964,983.

MFC is a material composed of nanosized cellulose fibrils, typically having a high aspect ratio (ratio of length to cross dimension). Typical lateral dimensions are from about 1 to about 100 nanometers, or from about 5 to about 20 nanometers, and longitudinal dimension is in a wide range from nanometers to several micrometers. For improved structuring, the MFC can have an average aspect ratio of from about 50 to about 200,000, optionally from about 100 to about 10,000.

Sugar beet pulp (SBP) is a by-product from the beet sugar industry. On a dry weight basis, sugar beet pulp typically contains 65-80% polysaccharides, consisting roughly of 40% cellulose, 30% hemicelluloses, and 30% pectin.

Chicory (*Cichorium intybus* L.) belongs to the Asteraceae family and is a biennial plant with many applications in the food industry. The dried and roasted roots are used for flavoring coffee.The young leaves can be added to salads and vegetable dishes, and chicory extracts are used for foods, beverages and the like. Chicory fibers, present in chicory root, are known to comprise pectine, cellulose, hemicelluloses, and inulin. Inulin is a polysaccharide which is composed of a chain of fructose units with a terminal glucose unit. Chicory roots are particularly preferred as a source of inulin, since they can be used for the production of inulin which comprises long glucose and fructose chains. Chicory fibers, used to make the MFC, can be derived as a by-product during the extraction of inulin. After the extraction of the inulin, chicory fibers typically form much of the remaining residue.

The fibers derived from sugar beet pulp and chicory comprise hemicelluloses. Hemicelluloses typically have a structure which comprises a group of branched chain compounds with the main chain composed of alpha-1,5-linked 1-arabinose and the side chain by alpha-1,3-linked 1-arabinose. Besides arabinose and galactose, the hemicelluloses also may contain xylose and glucose. Before use for structuring purposes, the fibers can be enzymatically treated to reduce branching.

Microfibrils, derived from vegetables or wood, include a large proportion of primary wall cellulose, also called parenchymal cell cellulose (PCC). It is believed that such microfibrils formed from such primary wall cellulose provide improved structuring. In addition, microfibrils in primary wall cellulose are deposited in a disorganized fashion, and are easy to dissociate and separate from the remaining cell residues via mechanical means.

The MFC can be derived from vegetables or wood which has been pulped and undergone a mechanical treatment comprising a step of high intensity mixing in water, until the vegetable or wood has consequently absorbed at least 15 times its own dry weight of water, or even at least 20 times its own dry weight, in order to swell it. It may be derived by an environmentally friendly process from a sugar beet or chicory root waste stream. This makes it more sustainable than prior art external structurants. Furthermore, it requires no additional chemicals to aid its dispersal and it can be made as a structuring premix to allow process flexibility. The process to make MFC derived from vegetables or wood, particularly from sugar beet or chicory root, is also simpler and less expensive than that for bacterial cellulose.

MFC derived from vegetables or wood, can be derived using any suitable process, such as the process described in U.S. Pat. No. 5,964,983. For instance, the raw material, such as sugar beet or chicory root, can first be pulped, before being partially hydrolyzed, using either acid or basic hydrolysis, to extract the pectins and hemicelluloses. The solid residue can then be recovered from the suspension, and a second extraction under alkaline hydrolysis conditions can be carried out, before recovering the cellulosic material residue by separating the suspension after the second extraction. The one or more hydrolysis steps are typically done at a temperature of from 60° C. to 100° C., more typically at from 70° C. to 95° C., with at least one of the hydrolysis steps being preferably under basic conditions. Caustic soda, potash, and mixtures thereof, is typically used at a level of less than 9 wt %, more preferably from 1% to 6% by weight of the mixture, for basic hydrolysis. The residues are then typically washed and optionally bleached to reduce or remove coloration. The residue is then typically made into an aqueous suspension, usually comprising 0.5 to 15 wt % solid matter, which is then homogenized. Homogenization can be done using any suitable equipment, and can be carried out by mixing or grinding or any other high mechanical shear operation, typically followed by passing the suspension through a small diameter orifice and preferably subjecting the suspension to a pressure drop of at least 20 MPa and to a high velocity shearing action followed by a high velocity decelerating impact.

Optional Components

In one aspect, the composition may comprise one or more adjunct components. A non-limiting list of adjuncts illustrated hereinafter that are suitable for use in the instant compositions and that may be desirably incorporated in certain aspects are set forth below. In addition to the foregoing adjunct components, suitable examples of other adjuncts and levels of use are found in U.S. Pat. Nos. 5,576,282; 6,306,812 B1; and 6,326,348 B1.

Methods of Use

A method of treating a fabric is disclosed. The method comprises the steps of contacting a fabric with a fabric treatment composition comprising a polymer and a fabric softening active, wherein the polymer may comprise a cationic repeating unit and a non-cationic repeating unit, wherein the polymer may have a weight-average molecular weight of from about 40,000 to about 600,000 Daltons, wherein the polymer may have a calculated cationic charge density of from about 0.05 to about 2 meq/g at a pH of between about 2 and about 8, wherein the polymer may comprise less than about 0.1% by mole of a cross-linking agent; wherein the fabric softening active may comprise a quaternary ammonium compound; and wherein the composition may comprise less than about 5% by weight of the composition of an anionic surfactant.

The method of treating a fabric may further comprise the steps of washing, rinsing, and/or drying the fabric before the step of contacting the fabric with the fabric treatment composition. Alternatively, the method of treating a fabric may further comprise the steps of washing, rinsing, and/or drying the fabric after the step of contacting the fabric with the fabric treatment composition. The method of treating a fabric may comprise the step of contacting the fabric with an external source of anionic surfactant before the step of contacting the fabric with the fabric treatment composition. The method of treating a fabric may further comprise the step of contacting the fabric with an external source of anionic surfactant before the steps of washing, rinsing, and/or drying the fabric. Contacting the fabric with an external source of anionic surfactant before the steps of washing, rinsing, and/or drying the fabric before or after the step of contacting the fabric with the fabric treatment composition may allow a greater color rejuvenation benefit in that the step provides for anionic surfactant to be present on the fabric which may allow for the anionic surfactant from the external source to form a coacervate with the fabric treatment composition. Without wishing to be bound by theory, it is believed that when there is anionic surfactant already on the fabric, the cationic polymer within the fabric treatment composition may then interact with the anionic surfactant in such a way as to form a coacervate that more readily deposits on the fabric as compared to the cationic polymer in the fabric treatment composition interacting with free floating anionic surfactant not found on the fabric, interacting to form a coacervate, and then inefficiently depositing the coacervate on the fabric. The method of treating a fabric may comprise the step of contacting the fabric with the fabric treatment composition, wherein the cationic polymer level in the washing machine liquor is from about 1 to about 500 ppm and wherein the fabric softening active in the washing machine liquor is from about 25 to about 500 ppm.

After treatment, the fabric may be actively dried, such as in an automatic drying machine. After treatment, the fabric may be passively dried, such as line-dried or dried when placed over a radiator. The method may comprise the steps of washing, rinsing, and/or drying the fabric before the step of contacting the fabric with the fabric treatment composition wherein the fabric is actively dried or passively dried.

The fabric treatment composition and the source of anionic surfactant may be combined in a treatment vessel. The treatment vessel may be any suitable reservoir sufficient to allow the fabric treatment composition and the source of anionic surfactant to interact, and may include top loading, front loading and/or commercial washing machines. The treatment vessel may be filled with water or other solvent before the addition of the fabric treatment composition. The fabric treatment composition and source of anionic surfactant may be combined in the presence of water.

The contacting step of the method may be carried out at a temperature of from about 15° C. to about 40° C. when combined within a treatment vessel. The contacting step of the method may be carried out at ambient temperature when combined outside of a treatment vessel.

The method may be carried out as a service to a consumer. The method may be carried out in a commercial establishment at the request of a consumer. The method may be carried out at home by the consumer.

The benefit may comprise a benefit selected from the group consisting of color maintenance and/or rejuvenation, abrasion resistance, wrinkle removal, pill prevention, anti-shrinkage, anti-static, anti-crease, fabric softness, fabric shape retention, suds suppression, decreased residue in the wash or rinse, improved hand feel or texture, and combinations thereof.

In one aspect, a method of forming a fabric treatment composition is disclosed, the method comprising the steps of forming an emulsion composition comprising a polymer and a fabric softening active, then adding a nonionic surfactant to the composition, and then adding a suds suppressor to the composition, and then adding an external structurant system to the composition.

Test Methods

The following section describes the test methods used in the present disclosure.

Garments

"New garments" are defined as garments not having undergone any fabric damaging protocol. "Damaged garments" are defined as garments having undergone a fabric damaging protocol. "De-sized garments" are defined as garments having undergone a fabric de-sizing protocol. "Treated garments" are defined as garments having undergone a fabric treatment protocol. For purposes of the detailed test protocols and examples, garments may include items such as tank tops and terry washcloths.

Fabric De-Sizing Protocol

Garments are de-sized by placing the garments in a top-loading washing machine, such as the Kenmore 80 series, for five washer cycles. For the first two washer cycles, 119±0.01 grams of AATCC 2003 Standard Reference HE Liquid Detergent WOB (without optical brightener), available for purchase from Testfabrics Inc., West Pittston, Pa., USA, per 2.5-2.6 kg load is added to the washing machine, followed by 2.5 kg of garments. The garments are washed using zero grain of hardness water on the "Heavy Duty" cycle. The two washer cycles are then followed by three "Heavy Duty" cycles without detergent.

The garments are then tumble-dried after the last washer cycle in a dryer, such as the Kenmore series. Garments are dried on the "High" setting for about 55 minutes.

Fabric Damaging Protocol

Garments are damaged by washing the garments for ten washer-dryer cycles. Garments are damaged by washing the garments in a top-loading washing machine, such as the Kenmore 600 series. 49.6±0.01 grams of commercially available TIDE® detergent manufactured by The Procter & Gamble Company, Cincinnati, Ohio, USA, is added to the washing machine, followed by 2.5 kg of garments (or about 25 whole American Apparel tank tops). The garments are washed using city water having about 6 grains per gallon average hardness and 1 ppm average chlorine on the "Heavy Duty Regular" cycle using a 17 gallon (64.35 Liters) fill volume of water for a wash cycle of about 12 minutes and a rinse cycle for about 2 minutes.

Garments are dried after each washer cycle using a dryer, such as the Maytag stackable dryer of model number MLE24PDAYW. The garments are then dried on the "Normal" cycle for about 60 minutes.

Fabric Treatment Protocol for Maintenance and or Rejuvenation

Garments are treated by washing the garments in a top-loading washing machine, such as the Kenmore 600 series. 49.6 ±0.01 grams of commercially available TIDE® detergent manufactured by The Procter & Gamble Company, Cincinnati, Ohio, USA, is added to the washing machine, followed by 2.5 kg of fabric which includes new garments or damaged garments and any other fabric items added as ballast to the drum of the machine. The garments are washed using city water having an average hardness of about 6 grains per gallon and an average chlorine level of about 1 ppm on the "Normal" cycle using a 17 gallon (64.35 Liters) fill volume of water for a wash cycle of about 6 minutes, a rinse cycle of about 1 minute, and a spin cycle of about 1-3 minutes. At the beginning of the rinse cycle, one or more doses of the rinse-added fabric softening active composition (along with cationic polymer to form a fabric treatment composition or deficient of cationic polymer, depending on the example run) are added to the rinse water in the washing machine drum. One dose of rinse-added fabric softening active composition is about 25.5 g and is of liquid form. For examples where no rinse-added fabric softening active composition and no fabric treatment composition is added, no other composition is added to the washing machine after the wash cycle.

Garments are dried after each washer cycle using a dryer, such as the Maytag stackable dryer of model number MLE24PDAYW. The garments are then dried on the "Normal" cycle for about 60 minutes.

Fabric Treatment Protocol for Fabric to Fabric Friction Change

Garments are treated by washing the garments in a top-loading washing machine, such as the Kenmore 80 series. 49.6±0.01 grams of commercially available TIDE® detergent manufactured by The Procter & Gamble Company, Cincinnati, Ohio, USA, is added to the washing machine, followed by 2.5 kg of fabric which includes de-sized garments and any other fabric items added as ballast to the drum of the machine. The garments are washed using city water having an average hardness of about 6 grains per gallon and an average chlorine level of about 1 ppm on the "Heavy Duty" cycle using a 17 gallon (64.35 Liters) fill volume of water for a wash cycle of about 6 minutes, a rinse cycle of about 1 minute, and a spin cycle of about 1-3 minutes. At the beginning of the rinse cycle, one or more doses of the rinse-added fabric softening active composition (along with cationic polymer to form a fabric treatment composition or deficient of cationic polymer, depending on the example run) are added to the rinse water in the washing machine drum. One dose of rinse-added fabric softening active composition is about 25.5 g and is of liquid form. For examples where no rinse-added fabric softening active composition and no fabric treatment composition is added, no other composition is added to the washing machine after the wash cycle.

Garments are dried after each washer cycle using a dryer, such as the Kenmore series dryer or a Maytag dryer. The garments are then dried on the "Cotton/High" cycle for about 50 minutes.

Determination of ΔL Protocol

The color and appearance benefit imparted to fabrics can be described, for example, in terms of the refractive index of the fiber before and after treatment of the fabric as defined as a ΔL value as measured via spectrophotometry (for example, via a Spectrophotomer CM-3610d, manufactured by Konica Minolta, Tokyo, Japan). A decrease in L value, represented by a negative ΔL value, indicates an improvement (or darkening) in color, which represents a color benefit. An increase in L value, represented by a positive ΔL value, indicates a worsening (or lightening) in color, which represents a color detriment.

When measuring for a benefit of color maintenance in the new garment as demonstrated in Examples 2 and 3 and Tables 2 and 3, the L value of a fabric is determined at the following time points: as received from the manufacturer before any Fabric Treatment Protocol to yield a $L_{(new)}$ value and after the predetermined number of Fabric Treatment Protocol wash cycles to yield a $L_{(treated)}$. The ΔL value is equal to the $L_{(treated)}$-the $L_{(new)}$ value. When measuring for a benefit of color rejuvenation in the damaged garment color as demonstrated in Example 4 and Table 4, the L value of a fabric is determined at the following time points: after application of the Fabric Damaging Protocol to yield a $L_{(damaged)}$ and after the predetermined number Fabric Treatment Protocol wash cycles to yield a $L_{(treated)}$. The ΔL value is equal to the $L_{(treated)}$ the $L_{(damaged)}$ value.

Physical Stability Observation Protocol

Physical stability is assessed by visual observation of the product in an undisturbed glass jar, where the width of the glass jar is from about 5.5 cm to about 6.5 cm and the height of the glass jar is from about 9 to about 11 cm, after 24 hours at 25° C. Jars are placed on a bench in a laboratory with overhead fluorescent lighting. Pictures are taken over time. The height of the liquid in the jar and the height of any visually observed phase separation are measured and the Stability Index per each sample are calculated. The Stability Index is defined as the height of the phase split divided by the height of the liquid in the glass jar. A product with no visually observable phase split has a stability index of zero.

Fabric to Fabric Friction Change Protocol and Calculation

The ability of a fabric care composition to lower the friction of a fabric surface over multiple wash cycles is assessed by determining the fabric to fabric friction change of cotton terry washcloths according to the following method. Lower friction is correlated with softer-feeling fabric.

Before testing for fabric to fabric friction, the test garments are de-sized according to the Fabric De-sizing Protocol, as detailed above, to "strip" the fabric of any manufacturer's finish that may have been present. De-sized garments are then treated according to the Fabric Treatment Protocol for Fabric to Fabric Friction Change, as detailed above, for a total of three washer-dryer cycles.

When the third washer-dryer cycle of the Fabric Treatment Protocol for Fabric to Fabric Friction Change is completed, the treated garments are equilibrated for a minimum of 8 hours at 23° C. and 50% relative humidity. Treated garments are laid flat and stacked no more than ten garments high while equilibrating.

A friction peel tester with a 2 kg force load cell is used to measure fabric to fabric friction (for example, via a Friction Peel Tester Model FP2250, manufactured by Thwing-Albert Instrument Company, West Berlin, N.J., USA). A clamping style sled having 6.4×6.4 cm footprint and weight of 200 g is used (for example, Item No. 00225-218, manufactured by Thwing Albert Instrument Company, West Berlin, N.J., USA). The distance between the load cell and the sled is set at 10.2 cm. The distance between the crosshead arm and the sample stage is adjusted to 25 mm, as measured from the bottom of the cross arm to the top of the stage. The instrument is configured with the following settings: T2 kinetic measure time of 10.0 seconds, total measurement time of 20.0 seconds, and test rate of 20 cm/minute.

Each treated garment is placed tag side down and the face of the treated garment is then defined as the side that is facing upwards. If there is no tag and the treated garment is different on the front and back, it is important to establish one side of the treated garment as being designated "face" and be consistent with that designation across all of the treated garments. The treated garment is then oriented so that the pile loops are pointing toward the left. An 11.4 cm×6.4 cm fabric swatch is cut from the treated garment using fabric shears, at 2.54 cm in from the bottom and side edges of the cloth. The fabric swatch is aligned so that the 11.4 cm length is parallel to the bottom of the treated garment and the 6.4 cm edge is parallel to the left and right sides of the treated garment. The treated garment from which the swatch is cut is then secured to the instrument's sample table while maintaining this same orientation.

The 11.4 cm×6.4 cm fabric swatch is attached to the clamping sled with the face side outward so that the face of the fabric swatch on the sled can be pulled across the face of the treated garment on the sample plate. The sled is then placed on the treated garment so that the loops of the fabric swatch on the sled are oriented against the nap of the loops of the treated garment. The sled is attached to the load cell. The crosshead is moved until the load cell registers 1.0-2.0 gf (gram force), and is then moved back until the load cell reads 0.0 gf. Next, the measurement is started and the kinetic coefficient of friction (kCOF) is recorded by the instrument every second during the sled drag.

For each treated garment, the average kCOF over the measurement time frame of 10 seconds to 20 seconds is calculated:

$$f_n=(kCOF_{10s}+kCOF_{11s}+kCOF_{12s}+\ldots+kCOF_{20s})/12$$

Then the average kCOF of the five treated garments per product is calculated:

$$F=(f_1+f_2+f_3+f_4+f_5)/5$$

The Friction Change for the test product versus the control detergent is calculated as follows:

$$F_{(control)}F_{(test\ product)}=\text{Friction Change}$$

Friction measurements for the test product and nil-polymer control product are made on the same day under the same environmental conditions used during the equilibration step.

EXAMPLES

Example 1

Sample Fabric Softening Active Compositions: Fabric softening active compositions are obtained having mixtures of the ingredients listed in the proportions shown in Table 1.

TABLE 1

| | Ingredient (wt % of the fabric softening active composition) | | | |
|---|---|---|---|---|
| | 1A | 1B | 1C | 1D |
| Fabric Softening Active[a] | 14.7% | 12% | 9.0% | 18% |
| Antifoam[b] | 0.015% | 0.015% | 0.015% | 0.015% |
| DTPA[c] | 0.0075% | 0.0075% | 0.0075% | 0.0075% |
| $CaCl_2$ | 0.01% | 0.01% | 0.01% | 0.01% |
| Perfume | 1.53% | 1.25% | 1.57% | 2.7% |
| Encapsulated Perfume[d] | 0.25% | 0.25% | 0.25% | 0.5% |
| Phase stabilizer[e] | 0.14% | 0.14% | 0.14% | 0.14% |
| Water, buffers, dyes, preservatives, and other optional components | Balance | Balance | Balance | Balance |

[a]A diester quaternary ammonium compound mixture with 9 parts ethanol and 3 parts coconut oil.
[b]Silicone antifoam agent available under the trade name DOW CORNING ® ANTIFOAM 2310 manufactured by the Dow Corning Corporation, Midland, Michigan, USA.
[c]Diethylenetriaminepentaacetic acid
[d]Aminoplast perfume accord encapsulates with available from Encapsys, LLC, Appleton, Wisconsin, USA.
[e]RHEOVIS ® CDE manufactured by BASF Corporation, Ludwigshafen, Germany.

Examples 2A-C

One Dose of Fabric Treatment Composition having Cationic Polymer and Fabric Softening Active Composition added per Cycle Improves and/or Maintains Color of Black 100% Cotton Tank Tops after 10 Full "Normal" Wash Cycles as Compared to One Dose added per Cycle of only the Fabric Softening Active Composition Examples 2A-C, as shown in Table 2, demonstrate the effect of the fabric treatment composition of the present disclosure, a cationic polymer and fabric softening active composition, on maintaining black color of new garments that were washed on "Normal" cycle for 10 cycles.

New black American Apparel tank tops (5.8 oz. 100% combined ring spun 2×1 rib cotton, ⅜ trim binding on armhole and neck, double-needle bottom hem, American Apparel style number: 0411AM; Color: Black; Size: Large or Extra Large) available from TSC Apparel, Cincinnati, Ohio, USA, were used as the garments in Examples 2A-C. The garments did not undergo any fabric damaging protocol prior to fabric treatment and thus are new garments. The new garments underwent the Fabric Treatment Protocol for Maintenance and or Rejuvenation for ten full washer-dryer cycles. Then, ΔL was calculated according to the Determination of ΔL Protocol.

Example 2A demonstrates that the black color of the new garments appears lighter with washing after 10 full "Normal" cycles when no rinse-added fabric softening active composition is added to the washing machine each cycle, as indicated by a positive ΔL of 0.88, or 0.88 units lighter. Example 2B demonstrates that the black color of the new garments appears lighter with washing after 10 full "Normal" cycles when one dose of rinse-added fabric softening active composition is added to the washing machine each cycle, as indicated by a positive ΔL of 0.62, or 0.62 units lighter. In comparison, Example 2C demonstrates that black color appears darker, or is maintained and/or even improved, with washing after 10 full "Normal" cycles when a combination of cationic polymer and rinse-added fabric softening active composition, such as the fabric treatment composition of the present disclosure, is added to the washing machine each cycle, as indicated by a negative ΔL of −0.3, or 0.3 units darker.

TABLE 2

| Example | Rinse-Added Softener Composition from Table 1 | Dose of Rinse-Added Softener Composition (1X = 25.5 g) | Cationic Polymer[a] (wt. %[b]) | ΔL after 10 full "Normal" cycles | Visual Appearance vs New |
|---|---|---|---|---|---|
| 2A | None | None | None | 0.88 | Lighter |
| 2B | 1C | 1X | None | 0.62 | Lighter |
| 2C | 1C | 1X | 5.9% | −0.3 | Darker |

[a]Poly(pyrrolidone-co-methacrylamide-co-vinylimidazole-co-quaternized vinylimidazole) (calculated charge density is 0.6 meq/g and 55:29:10:6 mol ratio) is added to the softener composition of 1C.
[b]By weight of the total fabric treatment composition.

Examples 3A-C

One Dose of Fabric Treatment Composition having Cationic Polymer and Fabric Softening Active Composition added per Cycle Improves and/or Maintains Color of Black 100% Cotton Tank Tops after 15 Full "Normal" Wash Cycles as Compared to Four Doses added per Cycle of only the Fabric Softening Active Composition Examples 3A-C, as shown in Table 3, demonstrate the effect of the fabric treatment composition of the present disclosure, a cationic polymer and fabric softening active composition, on maintaining black color of new garments that were washed on "Normal" cycle for 15 cycles as compared to four doses added per cycle of fabric softening active composition alone.

New black American Apparel tank tops (5.8 oz. 100% combined ring spun 2×1 rib cotton, ⅜ trim binding on armhole and neck, double-needle bottom hem, American Apparel style number: 0411AM; Color: Black; Size: Large or Extra Large) available from TSC Apparel, Cincinnati, Ohio, USA, were used as the garments in Examples 3A-C. The garments did not undergo any fabric damaging protocol prior to fabric treatment and thus are new garments. The new garments underwent the Fabric Treatment Protocol for Maintenance and or Rejuvenation for five, ten, and fifteen full washer-dryer cycles. Then, ΔL was calculated according to the Determination of ΔL Protocol after five full washer-dryer cycles, after ten full washer-dryer cycles, and after fifteen full washer-dryer cycles.

Example 3A demonstrates that the black color of the new garments appears lighter with washing after 5 full "Normal" cycles when no rinse-added fabric softening active composition is added to the washing machine each cycle, as indicated by a positive ΔL of 0.2, or 0.2 units lighter. The black color of the new garments appears even lighter with washing after 10 full "Normal" cycles when no rinse-added fabric softening active composition is added to the washing machine each cycle, as indicated by a positive ΔL of 1.1, or 1.1 units lighter than new, and even lighter after 15 full "Normal" cycles, as indicated by a positive ΔL of 1.5, or 1.5 units lighter than new.

Example 3B demonstrates that the black color of the new garments initially appears darker with washing after 5 full "Normal" cycles when four times the dose of rinse-added fabric softening active composition is added to the washing machine each cycle, as indicated by a by a negative ΔL of −0.9, or 0.9 units darker. The black color of the new garments appears darker with washing after 10 full "Normal" cycles when four times the dose of rinse-added vsoftening active composition is added to the washing machine each cycle, as indicated by a negative ΔL of −0.3, or 0.3 units darker. However, the black color of the new garments appears lighter with washing after 15 full "Normal" cycles when four times the dose of rinse-added fabric softening active composition is added to the washing machine each cycle, as indicated by a positive ΔL of 0.1, or 0.1 units lighter. Even when four times the regular dose of rinse-added fabric softening active composition is added to the washing machine each cycle, between about 10 and about 15 wash cycles, the color maintenance benefit begins to decline.

Example 3C demonstrates that black color appears darker, or is maintained and/or even improved, with washing after 5 full "Normal" cycles when a combination of cationic polymer and rinse-added fabric softening active composition, such as the fabric treatment composition of the present disclosure, is added to the washing machine each cycle, as indicated by a negative ΔL of −0.9, or 0.9 units darker. The black color appears darker, or is maintained and/or even improved, with washing after 10 full "Normal" cycles when a combination of cationic polymer and rinse-added fabric softening active composition, such as the fabric treatment composition of the present disclosure, is added to the washing machine each cycle, as indicated by a negative ΔL of −0.3, or 0.3 units darker. The black color appears darker, or is maintained and/or even improved, with washing after 15 full "Normal" cycles when a combination of cationic polymer and rinse-added fabric softening active composition, such as the fabric treatment composition of the present disclosure, is added to the washing machine each cycle, as indicated by a negative ΔL of −0.04, or 0.04 units darker.

Examples 3A-C demonstrate that using a fabric treatment composition having a cationic polymer and one dose of fabric softening active composition, such as that of the present disclosure, maintains and/or even improves the appearance of black color of fabric after 15 full "Normal" cycles whereas using even four times the dose of fabric softening active composition alone ceases to show a benefit after 15 full "Normal" cycles.

TABLE 3

| Example | Rinse-Added Softener Composition from Table 1 | Dose of Rinse-Added Softener Composition (1X = 25.5 g) | Cationic Polymer[a] (Wt. %)[b] | ΔL after full "Normal" cycles 5 cycles | 10 cycles | 15 cycles | Visual Appearance vs New |
|---|---|---|---|---|---|---|---|
| 3A (comp) | None | None | None | 0.2 | 1.1 | 1.5 | Lighter |
| 3B (comp) | 1C | 4X | None | −0.9 | −0.3 | 0.1 | Lighter |
| 3C | 1C | 1X | 5.9% | −0.5 | −0.3 | −0.04 | Equal |

[a]Poly(pyrrolidone-co-methacrylamide-co-vinylimidazole-co-quaternized vinylimidazole) (calculated charge density is 0.6 meq/g and 55:29:10:6 mol ratio) is added to the softener composition of 1C.
[b]By weight of the total fabric treatment composition.

Examples 4A-C

One Dose of Fabric Treatment Composition having Cationic Polymer and Fabric Softening Active Composition added per Cycle Rejuvenates Color of Pre-Damaged per the Fabric Damaging Protocol Black 100% Cotton Tank Tops after 3 Full "Normal" Wash Cycles Examples 4A-C, as shown in Table 4, demonstrate the effect of the fabric treatment composition of the present disclosure, having a cationic polymer and fabric softening active composition, on rejuvenating black color of pre-damaged per the Fabric Damaging Protocol new garments that were washed on "Normal" cycle for 3 cycles when compared to no treatment and to only rinse-added softener composition.

New black American Apparel tank tops (5.8 oz. 100% combined ring spun 2×1 rib cotton, ⅜ trim binding on armhole and neck, double-needle bottom hem, American Apparel style number: 0411AM; Color: Black; Size: Large or Extra Large) available from TSC Apparel, Cincinnati, Ohio, USA, were used as the garments in Examples 4A-C. The garments underwent the Fabric Damaging Protocol and are thus damaged garments. The damaged garments then underwent the Fabric Treatment Protocol for Maintenance and or Rejuvenation for three full washer-dryer cycles. Then, ΔL was calculated according to the Determination of ΔL Protocol.

Example 4A demonstrates that the black color of the damaged garments appears lighter with washing after 3 full "Normal" cycles when no rinse-added fabric softening active composition is added to the machine each cycle, as indicated by a positive ΔL of 0.5, or 0.5 units lighter. Example 4B demonstrates that the black color of the damaged garments appears lighter with washing after 3 full "Normal" cycles when one dose of rinse-added fabric softening active composition is added to the machine each cycle, as indicated by a positive ΔL of 0.3, or 0.3 units lighter. In comparison, Example 4C demonstrates that black color appears darker, or is rejuvenated and/or even improved, with washing after 3 full "Normal" cycles when a combination of cationic polymer and rinse-added fabric softening active composition, such as the fabric treatment composition of the present disclosure, is added to the machine each cycle, as indicated by a negative ΔL of −0.6, or 0.6 units darker. This darkening of the fabric rejuvenated the fabric to make it appear closer to when new.

TABLE 4

| Example | Rinse-Added Softener Composition from Table 1 | Dose of Rinse-Added Softener Composition (1X = 25.5 g) | Cationic Polymer[a] (Wt. %)[b] | ΔL after 3 full "Normal" cycles | Visual Appearance Treated vs Damaged Garment |
|---|---|---|---|---|---|
| 4A | None | None | None | 0.5 | Lighter |
| 4B | 1C | 1X | None | 0.3 | Lighter |
| 4C | 1C | 1X | 5.9% | −0.6 | Darker |

[a]Poly(pyrrolidone-co-methacrylamide-co-vinylimidazole-co-quaternized vinylimidazole) (calculated charge density is 0.6 meq/g and 55:29:10:6 mol ratio) is added to the softener composition of 1C.
[b]By weight of the total fabric treatment composition.

Examples 5A-B

Physical Stability of Fabric Treatment Compositions having 5.9% Cationic Polymer and Fabric Softening Active Composition after 24 Hours at Room Temperature.

Examples 5A-B, as shown in Table 5, demonstrate the difference in the physical stability of fabric treatment compositions having 5.9% cationic polymer and fabric softening active composition after 24 hours at room temperature, where the cationic polymers in the examples are of different polymers and charge density. Physical stability was observed and a stability index was assessed according to the Physical Stability Observation Protocol.

Example 5A demonstrates that when the fabric treatment composition contains a low charge density polymer, such as that of poly(pyrrolidone-co-methacrylamide-co-vinylimidazole-co-quaternized vinylimidazole) having a charge density of 0.6 meq/g at a neutral pH, there is no visible phase separation, or the composition remains homogeneous. Example 5B demonstrates that when the fabric treatment composition contains a high charge density polymer, such as that of poly(acrylamide-co-dimethylaminoethylacrylate) that has been quaternized having a charge density of 4.2 meq/g at a neutral pH, there is visible phase separation, or the composition does not remain homogeneous.

TABLE 5

| Example | Rinse-Added Composition from Table 1 | Dose of Rinse-Added Composition (1X = 25.5 g) | Cationic Polymer | Cationic Polymer Level (Wt. %)[c] | Physical Stability Observed at 24 Hours | Stability Index |
|---|---|---|---|---|---|---|
| 5A | 1C | 1X | a | 5.9% | Stable; No phase separation | 0 |
| 5B | 1C | 1X | b | 5.9% | Not stable; Phase separation | 0.6 |

[a]Poly(pyrrolidone-co-methacrylamide-co-vinylimidazole-co-quaternized vinylimidazole) (calculated charge density is 0.6 meq/g at neutral pH and 55:29:10:6 mol ratio) is added to the softener composition of 1C.
[b]Poly(acrylamide-co-dimethylaminoethylacrylate) that has been quaternized (calculated charge density is 4.2 meq/g at neutral pH and 40:60 mol ratio) is added to the softener active composition of 1C.
[c]By weight of the total fabric treatment composition.

Examples 6A-D

Fabric to Fabric Friction Reduction Results in Differences in Softness of Fabric Treatment Compositions having Cationic Polymer and Fabric Softening Active Examples 6A-D, as shown in Table 6, demonstrate the effect of the rinse-added fabric treatment composition of the present disclosure, having a cationic polymer and fabric softening active composition, on fabric to fabric friction on de-sized 100% cotton terrycloth towels that were washed for 3 cycles.

100% cotton terry washcloths (30.5 cm×30.5 cm, RN37002LL), available from Calderon Textiles, LLC, Indianapolis, Ind., USA, were used as the garments in Examples 6A-D. Per the Fabric to Fabric Friction Change Protocol, the garments underwent the de-sizing process of the Fabric De-Sizing Protocol, and are thus de-sized garments. The de-sized garments underwent the Fabric Treatment Protocol for Fabric to Fabric Friction Change for three full washer-dryer cycles. During the Fabric Treatment Protocol for Fabric to Fabric Friction Change, each washing machine cycle contained 2.5 kg of fabric including the de-sized garments (about 12 garments), and 50/50 polyester/cotton jersey knit fabrics (about 10 fabric swatches, 30.5 cm×30.5 cm, available from Testfabrics, Inc., West Pittston, Pa., USA, and two 100% size large cotton t-shirts available from Gildan, Montreal, Canada, included as ballast to the washing machine drum.

The kinetic coefficient of friction (kCoF) was then calculated according to the Fabric to Fabric Friction Change Protocol and Calculation. The kinetic coefficient of friction reduction was calculated by subtracting the kCoF of fabrics treated with no fabric softening composition from the kCoF of fabrics treated with the rinse-added fabric softening active composition. The larger the reduction in kCoF, the softer a fabric feels.

Example 6B demonstrates a reduction in kCoF in the fabrics after only the rinse-added fabric softening active composition is added to the washing machine as compared to when no rinse-added fabric softening active composition is added to the washing machine, as indicated by a negative 0.09 kCoF, or 0.09 units softer.

Example 6C demonstrates an increase in kCoF in the fabrics after only the cationic polymer is added to the washing machine as compared to when no-rinse added fabric softening active composition is added to the washing machine, as indicated by a positive 0.09 kCoF, or 0.09 units less soft.

Example 6D demonstrates a reduction in kCoF in the fabrics after a combination of cationic polymer and rinse-added fabric softening active composition, such as the fabric treatment composition of the present disclosure, is added to the washing machine as compared to when no rinse added fabric softening active composition is added to the washing machine, as indicated by a negative 0.52 kCoF, or 0.52 units softer. Example 6D demonstrates that there is a greater softness benefit in using a combination of cationic polymer and rinse-added fabric softening active composition, such as the fabric treatment composition of the present disclosure, as compared to when only rinse-added fabric softening active composition is added to the washing machine. Example 6D demonstrates that there is a softness benefit in using a combination of cationic polymer and rinse-added fabric softening active composition, such as the fabric treatment composition of the present disclosure, as compared to when only cationic polymer is added to the washing machine, where there is not a benefit.

TABLE 6

| Example | Rinse-Added Composition | Cationic Polymer[a] (Wt. %)[b] | Kinetic Coefficient of Friction | Kinetic Coefficient of Friction Reduction |
|---|---|---|---|---|
| 6A | None | None | 1.64 | REF |
| 6B | 1C | None | 1.55 | −0.09 units softer |
| 6C | None | 5.9% | 1.73 | +0.09 units less soft |
| 6D | 1C | 5.9% | 1.12 | −0.52 units softer |

[a]Poly(vinyl pyrrolidone-co-methacrylamide-co-imidazole-co-quaternized imidazole) (calculated charged density is 0.6 meq/g at a neutral pH and 55:29:10:6 mol ratio) is added to the softener composition of 1C.
[b]By weight of the total fabric treatment composition.

Combinations:

Specifically contemplated combinations of the disclosure are herein described in the following lettered paragraphs. These combinations are intended to be illustrative in nature and are not intended to be limiting.

A. A fabric treatment composition comprising a polymer and a fabric softening active:
wherein said polymer comprises:
a cationic repeating unit and a non-cationic repeating unit;
wherein said polymer has a weight-average molecular weight of from about 40,000 to about 600,000 Daltons;
wherein said polymer has a calculated cationic charge density of from about 0.05 to about 2 meq/g at a pH of between about 2 and about 8;
wherein said polymer comprises less than about 0.1% by mole of a cross-linking agent, preferably less than about 0.05% by mole of a cross-linking agent, more preferably less than about 0.01% by mole of a cross-linking agent;
(ii) wherein said fabric softening active comprises a quaternary ammonium compound; and
wherein said composition comprises less than about 5% by weight of the composition of an anionic surfactant.

B. The fabric treatment composition according to paragraph A, wherein said composition comprises
(i) from about 0.5% to about 25% by weight of the composition of said polymer;
(ii) from about 1% to about 49% by weight of the composition of said fabric softening active; and
(iii) from about 0.1% to about 20% of a perfume.

C. The fabric treatment composition according to any one of paragraphs A or B, wherein said cationic repeating unit is selected from the group consisting of quaternized dimethylaminoethyl acrylate, quaternized dimethylaminoethyl methacrylate, diallyldimethylammonium chloride, vinylimidazole and its quaternized derivatives, methacrylamidopropyltrimethylammonium chloride, and mixtures thereof.

D. The fabric treatment composition according to any one of paragraphs A to C, wherein said non-cationic repeating unit is selected from the group consisting of acrylamide, methacrylamide, acrylic acid, vinyl formamide, vinyl pyrrolidone, vinyl acetate, ethylene oxide, propylene oxide, and mixtures thereof.

E. The fabric treatment composition according to paragraph A or B, wherein said polymer is a cationic polymer comprising a polymer selected from the group consisting of poly(acrylamide-co-diallyldimethylammonium chloride), poly(acrylamide-co-N,N-dimethyl aminoethyl acrylate) and its quaternized derivatives, poly(acrylamide-co-N,N-dimethylaminoethyl methacrylate) and its quaternized derivatives, poly(diallyldimethylammonium chloride-co-acrylic acid), poly(methylacrylamide-co-dimethylaminoethyl acrylate) and its quaternized derivatives, poly(vinylformamide-co-acrylic acid-co-diallyldimethylammonium chloride), poly(acrylamide-co-acrylic acid-co-diallyldimethylammonium chloride), poly(vinylformamide-co-diallyldimethylammonium chloride), poly (acrylamide-co-acrylic acid-co-diallyldimethylammonium chloride), poly(pyrrolidone-co-methacrylamide-co-vinylimidazole-co-quaternized vinylimidazole), poly (vinylformamide-co-diallyldimethylammonium chloride), poly(vinylpyrrolidone-co-acrylamide-co-vinyl imidazole) and its quaternized derivatives, poly(vinylpyrrolidone-co-methacrylamide-co-vinyl imidazole) and its quaternized derivatives, poly(vinylpyrrolidone-co-vinylacetate-co-diallyldimethylammonium chloride), and mixtures thereof.

F. The fabric treatment composition according to any one of paragraphs A to E, wherein said quaternary ammonium compound comprises an alkyl quaternary ammonium compound selected from the group consisting of monoalkyl quaternary ammonium compounds, a dialkyl quaternary ammonium compounds, a trialkyl quaternary ammonium compounds, and mixtures thereof.

G. The fabric treatment composition according to any one of paragraphs A to F, wherein said fabric softening active comprises a quaternary ammonium compound selected from the group consisting of linear quaternary ammonium compounds, branched quaternary ammonium compounds, cyclic quaternary ammonium compounds, and mixtures thereof, said quaternary ammonium compounds comprising one or more fatty acid moieties having an average chain length of from about 10 to about 22 carbon atoms and an iodine value of from 0 to 95, preferably of from 0.5 to 60.

H. The fabric treatment composition according to any one of paragraphs A to G, wherein said quaternary ammonium compound is selected from the group consisting of bis-(2-hydroxyethyl)-dimethylammonium methylsulfate fatty acid ester, bis-(2-hydroxyethyl)-dimethylammonium chloride fatty acid ester, bis-(2-hydroxypropyl)-dimethylammonium methylsulphate fatty acid ester, bis-(2-hydroxypropyl-dimethylammonium chloride fatty acid ester, and mixtures thereof, wherein said fatty acid moieties having an average chain length of from about 16 to about 18 carbon atoms and an iodine value of from 0.5 to 60.

I. The fabric treatment composition according any one of paragraphs A to H, wherein said composition further comprises a silicone, wherein said silicone is preferably selected from the group consisting of cyclic silicones, polydimethylsiloxanes, aminosilicones, cationic silicones, anionic silicones, silicone polyethers, silicone resins, silicone urethanes, and mixtures thereof.

J. The fabric treatment composition according to any one of paragraphs A to I, wherein said composition further comprises from about 0.1% to about 8% by weight of the composition of a nonionic surfactant; and wherein said composition is substantially free of anionic surfactant.

K. The fabric treatment composition according to any one of paragraphs A to J, wherein said composition further comprises from about 0.01% to about 1% by weight of the composition of a suds suppressor, preferably wherein said suds suppressor is silicone-based.

L. The fabric treatment composition according to any one of paragraphs A to K, wherein said composition further comprises from about 0.03% to about 1%, preferably from about 0.06% to about 1%, by weight of the composition of an external structuring system, preferably wherein said external structuring system comprises a structurant selected from the group consisting of microfibrillated cellulose, cross-linked cationic polymers, triglycerides, polyacrylates, and mixtures thereof.

M. A method of treating a fabric comprising the steps of contacting a fabric with said fabric treatment composition according to any one of paragraphs A to L.

N. The method of treating a fabric according to paragraph M, further comprising the steps of washing, rinsing, and/or drying said fabric before the step of contacting said fabric with said fabric treatment composition according to any one of paragraphs A to L.

O. The method of treating a fabric according to any one of paragraphs M or N, further comprising the step of contacting said fabric with an external source of anionic surfactant before the step of contacting said fabric with said fabric treatment composition.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitation were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document not an admission that it prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric treatment composition comprising a polymer and a fabric softening active:

(i) wherein said polymer is a quaternized derivative of poly(vinylpyrrolidone-co-methacrylamide-co-vinyl imidazole);

wherein said polymer has a weight-average molecular weight of from about 100,000 to about 500,000 Daltons;

wherein said polymer has a calculated cationic charge density of from about 0.05 to about 2 meq/g at a pH of between about 2 and about 8;

wherein said polymer comprises less than about 0.1% by mole of a cross-linking agent; and wherein said polymer is present at a level of from about 2% to about 15%, by weight of the fabric treatment composition;

(ii) wherein said fabric softening active comprises a quaternary ammonium compound; and (iii) wherein said composition is substantially free of anionic surfactant.

2. The fabric treatment composition according to claim 1, wherein said composition comprises:

from about 1% to about 49% by weight of the composition of said fabric softening active; and from about 0.1% to about 20% of a perfume.

3. The fabric treatment composition according to claim 1, wherein said quaternary ammonium compound comprises an alkyl quaternary ammonium compound selected from the group consisting of monoalkyl quaternary ammonium compounds, a dialkyl quaternary ammonium compounds, a trialkyl quaternary ammonium compounds, and mixtures thereof.

4. The fabric treatment composition according to claim 1, wherein said fabric softening active comprises a quaternary ammonium compound selected from the group consisting of linear quaternary ammonium compounds, branched quaternary ammonium compounds, cyclic quaternary ammonium compounds, and mixtures thereof, wherein said quaternary ammonium compound comprises one or more fatty acid moieties having an average chain length of from about 10 to about 22 carbon atoms and an iodine value of from 0 to about 95.

5. The fabric treatment composition according to claim 4, wherein said iodine value is from about 0.5 to about 60.

6. The fabric treatment composition according to claim 4, wherein said quaternary ammonium compound is selected from the group consisting of bis-(2-hydroxyethyl)-dimethylammonium methylsulfate fatty acid ester, bis-(2-hydroxyethyl)-dimethylammonium chloride fatty acid ester, bis-(2-hydroxypropyl)-dimethylammonium methylsulphate fatty acid ester, bis-(2-hydroxypropyl-dimethylammonium chloride fatty acid ester, and mixtures thereof, wherein said fatty acid moieties have an average chain length of from about 16 to about 18 carbon atoms and an iodine value of from 0.5 to 60.

7. The fabric treatment composition according to claim 1, wherein said composition further comprises a silicone.

8. The fabric treatment composition according to claim 7, wherein said silicone is selected from the group consisting of cyclic silicones, polydimethylsiloxanes, aminosilicones, cationic silicones, anionic silicones, silicone polyethers, silicone resins, silicone urethanes, and mixtures thereof.

9. The fabric treatment composition according to claim 1, wherein said composition is substantially free of anionic surfactant.

10. The fabric treatment composition according to claim 1, wherein said composition further comprises between about 0.1% and about 1% by weight of a suds suppressor.

11. The fabric treatment composition according to claim 10, wherein said suds suppressor is silicone-based.

12. The fabric treatment composition according to claim 1, wherein said composition further comprises from about 0.03% to about 1% by weight of the composition of an external structuring system.

13. The fabric treatment composition according to claim 12, wherein said external structuring system comprises a structurant selected from the group consisting of microfibrillated cellulose, cross-linked cationic polymers, triglycerides, polyacrylates, and mixtures thereof.

14. A method of treating a fabric comprising the steps of contacting a fabric with a fabric treatment composition comprising a polymer and a fabric softening active:

(i) wherein said polymer is a quaternized derivative of poly(vinylpyrrolidone-co-methacrylamide-co-vinyl imidazole);

wherein said polymer has a weight-average molecular weight of from about 100,000 to about 500,000 Daltons;

wherein said polymer has a calculated cationic charge density of from about 0.05 to about 2 meq/g at a pH of between about 2 and about 8;

wherein said polymer comprises less than about 0.1% by mole of a cross-linking agent; and wherein said polymer is present at a level of from about 2% to about 15%, by weight of the fabric treatment composition;

(ii) wherein said fabric softening active comprises a quaternary ammonium compound; and (iii) wherein said composition is substantially free of anionic surfactant.

15. The method of treating a fabric according to claim 14, further comprising the steps of washing, rinsing, and/or drying said fabric before the step of contacting said fabric with said fabric treatment composition.

16. The method of treating a fabric according to claim 14, further comprising the steps of contacting said fabric with an external source of anionic surfactant before the step of contacting said fabric with said fabric treatment composition.

* * * * *